US011582568B2

(12) United States Patent
Andersson

(10) Patent No.: US 11,582,568 B2
(45) Date of Patent: Feb. 14, 2023

(54) PROSTHESIS ADAPTER

(71) Applicant: Marcus Andersson, Gothenburg (AU)

(72) Inventor: Marcus Andersson, Gothenburg (AU)

(73) Assignee: Cochlear Limited, Macquarie University (AU)

( * ) Notice: Subject to any disclaimer, the term of this patent is extended or adjusted under 35 U.S.C. 154(b) by 564 days.

(21) Appl. No.: 16/543,869

(22) Filed: Aug. 19, 2019

(65) Prior Publication Data

US 2020/0059743 A1 Feb. 20, 2020

Related U.S. Application Data

(60) Continuation of application No. 15/069,101, filed on Mar. 14, 2016, now Pat. No. 10,425,750, which is a division of application No. 13/723,802, filed on Dec. 21, 2012, now abandoned.

(51) Int. Cl.
*H04R 25/00* (2006.01)

(52) U.S. Cl.
CPC ..... *H04R 25/556* (2013.01); *H04R 25/60* (2013.01); *H04R 25/606* (2013.01); *H04R 25/30* (2013.01); *H04R 2225/021* (2013.01); *H04R 2225/67* (2013.01); *H04R 2460/13* (2013.01)

(58) Field of Classification Search
CPC .... H04R 25/30; H04R 25/606; H04R 25/608; H04R 2225/67; H04R 2460/13; H04R 25/556; H04R 2225/021
See application file for complete search history.

(56) References Cited

U.S. PATENT DOCUMENTS 5,935,170 A * 8/1999 Hakansson ..... H04R 25/606 600/25

* cited by examiner

*Primary Examiner* — Christine H Matthews
*Assistant Examiner* — Joshua Daryl D Lannu
(74) *Attorney, Agent, or Firm* — Pilloff Passino & Cosenza LLP; Martin J. Cosenza

(57) ABSTRACT

A prosthesis including an abutment, an operationally removable component including a coupling apparatus, and an adapter, wherein the abutment is connected to the adapter and the coupling apparatus of the operationally removable component is releasably coupled to the adapter.

25 Claims, 23 Drawing Sheets

PROSTHESIS ADAPTER

CROSS-REFERENCE TO RELATED APPLICATIONS

The present application is a Continuation application of U.S. patent application Ser. No. 15/069,101, filed Mar. 14, 2016, naming Marcus ANDERSSON as an inventor, which is a Divisional application of U.S. patent application Ser. No. 13/723,802, filed Dec. 21, 2012, now abandoned, the entire contents of these applications being hereby incorporated by reference herein in their entirety.

BACKGROUND

Field of the Invention

Some embodiments relate generally to prostheses and, more particularly, to a prosthesis having an adapter.

Related Art

For persons who cannot benefit from traditional acoustic hearing aids, there are other types of commercially available hearing prostheses such as, for example, bone conduction hearing prostheses (commonly referred to as "bone conduction devices"). Bone conduction devices mechanically transmit sound information to a recipient's cochlea by transferring vibrations to a person's skull. This enables the hearing prosthesis to be effective regardless of whether there is disease or damage in the middle ear.

Traditionally, bone conduction devices transfer vibrations from an external vibrator to the skull through a bone conduction implant that penetrates the skin and is physically attached to both the vibrator and the skull. Typically, the external vibrator is connected to the percutaneous bone conduction implant located behind the outer ear facilitating the efficient transfer of sound via the skull to the cochlea. The bone conduction implant connecting the vibrator to the skull generally comprises two components: a bone attachment piece (e.g., bone fixture/fixture) that is attached or implanted directly to the skull, and a skin penetrating piece attached to the bone attachment piece, commonly referred to as an abutment.

SUMMARY

In one embodiment, there is a prosthesis, comprising, an abutment, an operationally removable component including a coupling apparatus, and an adapter, wherein the abutment is connected to the adapter and the coupling apparatus is releasably coupled to the adapter.

In another embodiment, there is a prosthesis structural component, comprising, an adapter configured to indirectly couple a coupling apparatus of an operationally removable component to a coupling apparatus of a body interfacing prosthesis.

In another embodiment, there is a method of converting a coupling mechanism of a prosthesis, comprising, obtaining access to an abutment fixed at least one of directly or indirectly to a recipient, and attaching an adapter to the abutment while the abutment is fixed to the recipient.

In another embodiment, there is a method of imparting vibrations into a recipient, comprising vibrating a vibrator in response to an external stimulus;

conducting the vibrations from a unit of which the vibrator is a part of to an implanted prosthesis at a location above an outer skin of the recipient relative to an interior of the recipient, the unit being removably coupled to the implanted prosthesis, conducting the vibrations from a first apparatus of the implanted prosthesis to a second apparatus of the implanted prosthesis, the first apparatus being at least partially located above the outer skin of the recipient relative to an interior of the recipient, and conducting the vibrations from the second apparatus of the prosthesis indirectly to bone of the recipient, the second apparatus being at least partially located below the outer skin of the recipient relative to the interior of the recipient and not in direct contact with bone of the recipient.

BRIEF DESCRIPTION OF THE DRAWINGS

Embodiments of the present invention are described herein with reference to the attached drawing sheets in which.

DETAILED DESCRIPTION

In an exemplary embodiment, there is a bone conduction device including an abutment attached to a bone fixture. The bone fixture is configured to be attached to bone of a recipient. An adapter is connected to the abutment, and a vibrator unit, sometimes referred to as a sound processor unit in embodiments that also include a sound processor in the unit, is releasably coupled to the adapter. The vibrator unit includes a coupling apparatus that is not compatible for direct coupling to the abutment because the abutment is configured for direct attachment to a different type of vibrator unit. The adapter thus enables the vibrator unit to be attached, indirectly, to the abutment.

Figure 1:
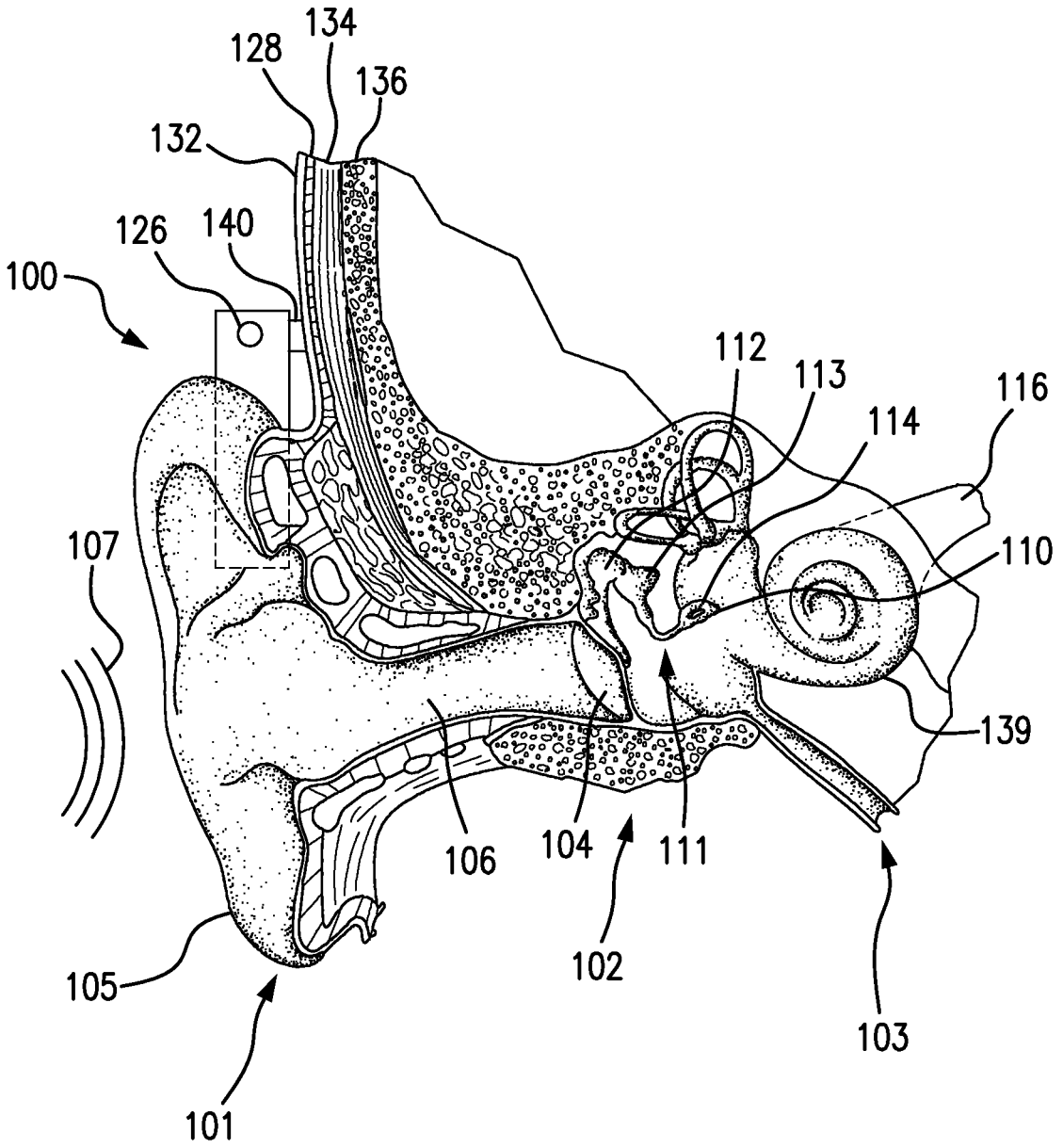
FIG. 1 depicts a perspective view of a percutaneous bone conduction device in which embodiments of the present invention can be implemented.

FIG. 1 is a perspective view of a bone conduction device 100 in which embodiments of the present invention can be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element can comprise, for example, a microphone, telecoil, etc. In an exemplary embodiment, sound input element 126 can be located, for example, on or in bone conduction device 100, or on a cable extending from bone conduction device 100.

In an exemplary embodiment, bone conduction device 100 comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100. Such releasable coupling is accomplished via a coupling apparatus of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a vibrator, corresponding to a genus of which these are species of) and/or various other operational components, such as sound input device 126. In this regard, the operationally removable component is sometimes referred to herein as a vibrator unit. More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull. It is noted that in some embodiments, the operationally removable component is a vibration sensor. In this regard, the operationally removable component can be a transducer, which is a genus that includes at least the species vibration sensor and vibrator.

As illustrated, the operationally removable component of the bone conduction device 100 further includes a coupling apparatus 140 configured to operationally removably attach the operationally removable component to a bone conduction implant (also referred to as an anchor system and/or a fixation system) which is implanted in the recipient. In the embodiment of FIG. 1, coupling apparatus 140 is coupled to the bone conduction implant (not shown) implanted in the recipient in a manner that is further detailed below with respect to exemplary embodiments of the bone conduction implant. Briefly, now with reference to FIG. 2A, an exemplary bone conduction implant 201 can include a percutaneous abutment attached to a bone fixture via a screw, the bone fixture being fixed to the recipient's skull bone 136. The abutment extends from the bone fixture which is screwed into bone 136, through muscle 134, fat 128 and skin 132 so that the coupling apparatus can be attached thereto. Such a percutaneous abutment provides an attachment location for the coupling apparatus that facilitates efficient transmission of mechanical force.

Figure 2A:
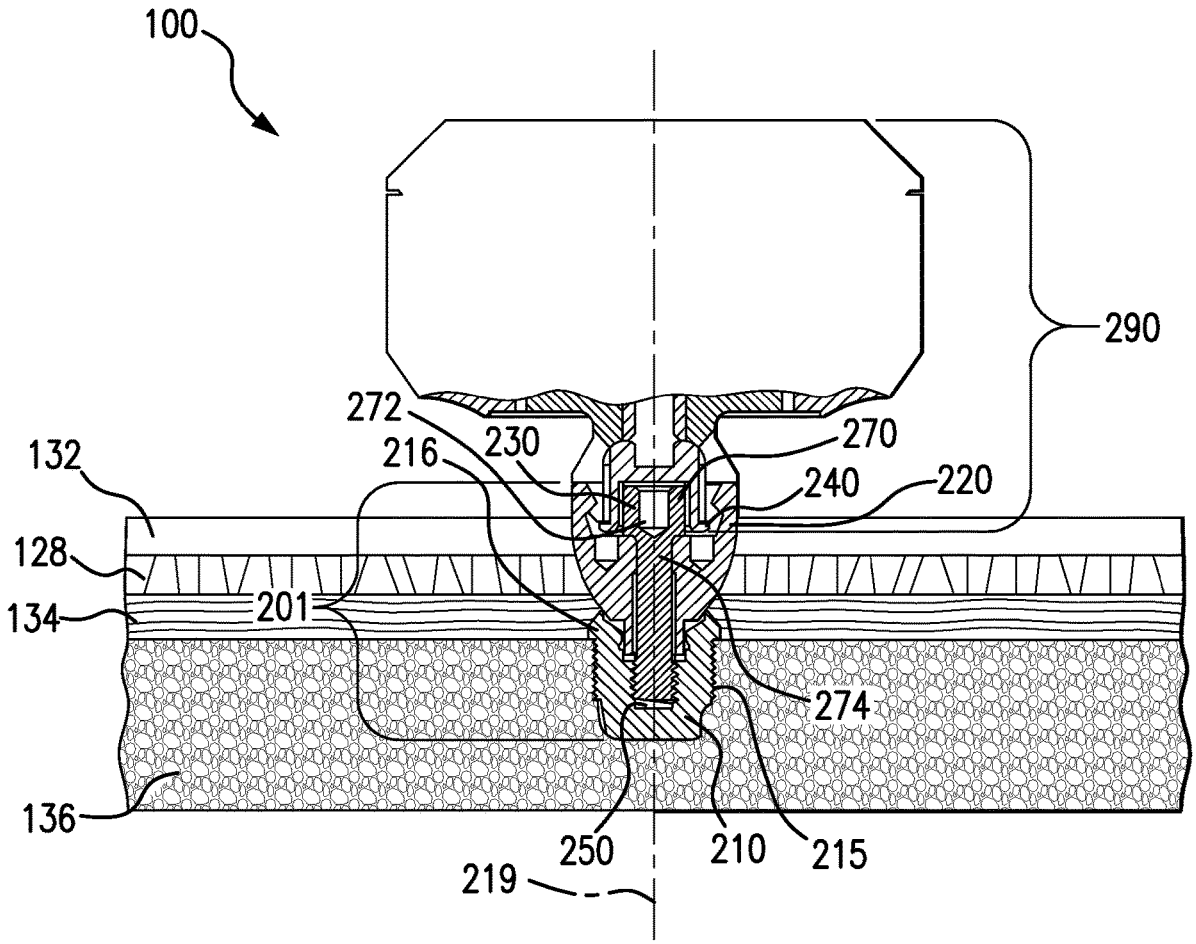
FIG. 2A depicts a side view of a bone conduction device according to an embodiment.

FIG. 2A depicts additional details of the bone conduction device 100. More particularly, the bone conduction device 100 is shown as including operationally removable component 290 vibrationally connected to and removably coupled to an exemplary bone conduction implant 201 via coupling apparatus 140 (corresponding to coupling apparatus 240) thereof. More particularly, operationally removable component 290 includes a vibrator (not shown) that is in vibrational communication to coupling apparatus 240 such that vibrations generated by the vibrator in response to a sound captured by sound capture device 126 are transmitted to coupling apparatus 240 and then to bone conduction implant 201 in a manner that at least effectively evokes hearing percept. By "effectively evokes a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. In an exemplary embodiment, the vibrational communication effectively evokes a hearing percept, if not a functionally utilitarian hearing percept.

Bone conduction implant 201 includes a bone fixture 210 configured to screw into the skull bone 136, a skin-penetrating abutment 220 and an abutment screw 230 that is in the form of an elongate coupling shaft. As may be seen, the abutment screw 230 connects and holds the abutment 220 to the fixture 210, thereby rigidly attaching abutment 220 to bone fixture 210. The rigid attachment is such that the abutment is vibrationally connected to the fixture 210 such that at least some of the vibrational energy transmitted to the abutment is transmitted to the fixture in a sufficient manner to effectively evoke a hearing percept.

It is noted that by way of example only and not by way of limitation, FIG. 2A and the figures thereafter are drawn to scale, although other embodiments can be practiced having different scales.

Some exemplary features of the bone fixture 210 will now be described, followed by exemplary features of the abutment 220 and the abutment screw 230.

Bone fixture 210 (hereinafter sometimes referred to as fixture 210) can be made of any material that has a known ability to integrate into surrounding bone tissue (i.e., it is made of a material that exhibits acceptable osseointegration characteristics). In one embodiment, fixture 210 is formed from a single piece of material and has a main body. In an embodiment, the fixture 210 is made of titanium. The main body of bone fixture 210 includes outer screw threads 215 forming a male screw which is configured to be installed into the skull 136. Fixture 210 also comprises a flange 216 configured to function as a stop when fixture 210 is installed into the skull. Flange 216 prevents the bone fixture 210 in general, and, in particular, screw threads 215, from potentially completely penetrating through the skull. Fixture 210 can further comprise a tool-engaging socket having an internal grip section for easy lifting and handling of fixture 210, as will be described in further detail below. An exemplary tool-engaging socket is described and illustrated in U.S. Provisional Application No. 60/951,163, entitled "Bone Anchor Fixture for a Medical Prosthesis," filed Jul. 20, 2007, by Applicants Lars Jinton, Erik Holgersson and Peter Elmberg which, in some embodiments, can be used exactly as detailed therein and/or in a modified form, to install and manipulate the bone fixture 210.

The body of fixture 210 can have a length sufficient to securely anchor the fixture 210 to the skull without penetrating entirely through the skull. The length of the body can therefore depend on the thickness of the skull at the implantation site. In one embodiment, the fixture 210 has a length that is no greater than 5 mm, measured from the planar bottom surface of the flange 216 to the end of the distal region (the portion closest to the brain), which limits and/or prevents the possibility that the fixture 210 might go completely through the skull). In another embodiment, this length can be anywhere from about 3.0 mm to about 5.0 mm.

The distal region of fixture 210 can also be fitted with self-tapping cutting edges (e.g., three edges) formed into the exterior surface of the fixture 210. Further details of the self-tapping features are described in International Patent Application Publication WO 02/09622, and can be used with some embodiments of bone fixtures exactly as detailed therein and/or in a modified form, to configure the fixtures detailed herein to be installed into a skull.

As illustrated in FIG. 2A, flange 216 has a planar bottom surface for resting against the outer bone surface, when bone fixture 210 has been screwed down into the skull. Flange 216 can have a diameter which exceeds the peak diameter (maximum diameter) of the screw threads 215 (the screw threads 215 of the fixture 210 can have a maximum diameter of about 3.5 to about 5.0 mm). In one embodiment, the diameter of the flange 216 exceeds the peak diameter of the screw threads 215 by approximately 10-20%. Although flange 216 is illustrated in FIG. 2A as being circular, flange 216 can be configured in a variety of shapes so long as flange 216 has a diameter or width that is greater than the peak diameter of the screw threads 215. Also, the size of flange 216 can vary depending on the particular application for which the bone conduction implant 201 is intended.

As may be seen in FIG. 2A, the outer peripheral surface of flange 216 has a cylindrical part and a flared top portion. The upper end of flange 216 is designed with an open cavity having a tapered inner side wall. The tapered inner side wall 217 is adjacent to the grip section (not shown). The interior of the fixture 210 further includes an inner lower bore 250 having female screw threads for securing a coupling shaft of abutment screw 230 (described further below). As may be seen, the fixture 210 further includes an inner upper bore 260 that receives a bottom portion of abutment 220.

In an exemplary embodiment, the flange 216 can be in the form of a protruding hex instead of being circular. That is, flange 216 can have a hexagonal cross-section that lies on a plane normal to the longitudinal axis 219 of the bone fixture 220/bone conduction implant 201 such that a female hex-head socket wrench can be used to apply torque to the bone fixture 210. However, in the embodiment illustrated in FIG. 2A, the flange 216 has a smooth, upper end that has a circular cross-section that lies on the aforementioned plane, and thus does not have a protruding hex. The smooth upper end of the flange 216 and the absence of any sharp corners provides for improved soft tissue adaptation. As mentioned above, flange 216 also comprises a cylindrical part which, together with the flared upper part, provides sufficient height in the longitudinal direction for connection with the abutment 220.

It is noted that the bone fixture depicted in FIG. 2A and the following figures are exemplary. Any bone fixture of any type, size/having any geometry can be used in some embodiments providing that the bone fixture permits embodiments as detailed herein and variations thereof to be practiced.

As noted above, bone conduction implant 201 further includes an abutment screw 230 as depicted in FIG. 2A. Abutment screw 230 includes a screw head 270 that has an internal upper bore 272 that can form a unigrip, internal hex or multi-lobular configuration for a cooperating insertion tool (not illustrated here). The screw head 270 is connected to elongate member 274 that extends downward as shown. At the bottom of the abutment screw 230 are male screw thread formed in the elongate member 274. These male screw threads are dimensioned to interact with the corresponding female threads of inner lower bore of bone fixture 210. Upon application of a tightening torque to abutment screw 230, screw head 270 reacts against the corresponding surface of abutment 220 to pull abutment 220 to fixture 210, as will be described further below.

In an exemplary embodiment, the screw head 270 includes male screw threads (not shown) thereabout, although other embodiments do not include such screw threads. While the embodiment depicted in FIG. 2A does not utilize those screw threads for removable attachment of the operationally removable component 290 to the bone conduction implant 201 (the coupling apparatus 240 generally does not contact the screw head 270 in some embodiments, and slides along the outside of the threads during installation in other embodiments), in some embodiments, the screw threads have utility in, for example, diagnostic methods and/or therapeutic methods.

It is noted that the abutment screw depicted in FIG. 2A and the following figures are exemplary. Any abutment screw of any type, size/having any geometry can be used in some embodiments providing that the abutment screw permits embodiments as detailed herein and variations thereof to be practiced.

As noted above, bone conduction implant 201 further includes an abutment 220 as depicted in FIG. 2A. In the embodiment of FIG. 2A, abutment 220 is symmetrical with respect to at least those portions above the top portion of the bone fixture 210. In this regard, the exterior surfaces of abutment 220 depicted in FIG. 2A form concentric outer profiles about longitudinal axis 219. As may be seen, the exterior surfaces of abutment 220 establish diameters lying on planes normal to longitudinal axis 219 that vary along the length of longitudinal axis 219. More specifically, abutment 220 includes outer diameters that progressively become larger with increased height until about the portions proximate the end. In other embodiments, the outer diameters become progressively larger until the end, and other embodiments can have other outer profiles. In an exemplary embodiment, the abutment can correspond to any of those detailed in U.S. patent application Ser. No. 13/270,691, filed Oct. 11, 2011, by Applicants Goran Björn, Stefan Magnander and Dr. Marcus Andersson and/or variations thereof. Any abutment of any configuration can be utilized in some embodiments providing that those embodiments enable the teachings detailed herein and/or variations thereof to be practiced.

In an exemplary embodiment, the abutment 220 (and the other abutments detailed herein and/or variations thereof) is configured for integration between the skin and the abutment 220. Integration between the skin and the abutment 220 can be considered to occur when the soft tissue of the skin encapsulates the abutment in fibrous tissue and does not readily dissociate itself from the abutment. This too inhibits the entrapment and/or growth of microbes proximate the bone conduction implant.

In an exemplary embodiment, the abutments usable in some embodiments are configured according to the teachings of the aforementioned U.S. Provisional Patent Application No. 60/951,163, entitled "Bone Anchor Fixture for a Medical Prosthesis," filed Jul. 20, 2007, by Applicants Lars Jinton, Erik Holgersson and Peter Elmberg. For example, such abutments can have a surface as disclosed therein and/or variations thereof that have features which reduce certain adverse skin reactions, and which can be implemented in embodiments of the present invention. In some embodiments, the abutments are coated to reduce the shear modulus, which can also encourage skin integration with the abutment. In an exemplary embodiment, at least a portion of the abutments detailed herein are coated with or otherwise contain a layer of hydroxyapatite that enhances the integration of skin with the abutment. In some embodiments, the surface features of the abutment correspond to any of those of U.S. patent application Ser. No. 13/270,691, and/or variations thereof that enable or otherwise promote skin integration relative to an abutment without those features.

It is noted that in some embodiments, some and/or all of the devices, systems and/or methods detailed herein and/or variations thereof can be practiced with an abutment that is integrated with skin of the recipient. In this regard, some embodiments have utility in that the teachings detailed herein and/or variations thereof can be practiced without substantially (including at all) and/or without effectively disturbing skin integration with the abutments detailed herein and/or variations thereof, as will be described in greater detail below.

The bottom of the abutment 220 includes a fixture connection section extending below a reference plane extending across the top of fixture 210 that interfaces with fixture 210. Upon sufficient tensioning of abutment screw 230, abutment 220 sufficiently elastically and/or plastically stresses bone fixture 210, and/or visa-versa, so as to form an effectively hermetic seal at the interface of surfaces of the abutment 220 and fixture 210. Such can reduce (including eliminate) the chances of micro-leakage of microbes into the gaps between the abutment 220, fixture 210 and abutment screw 230.

Figure 2B:
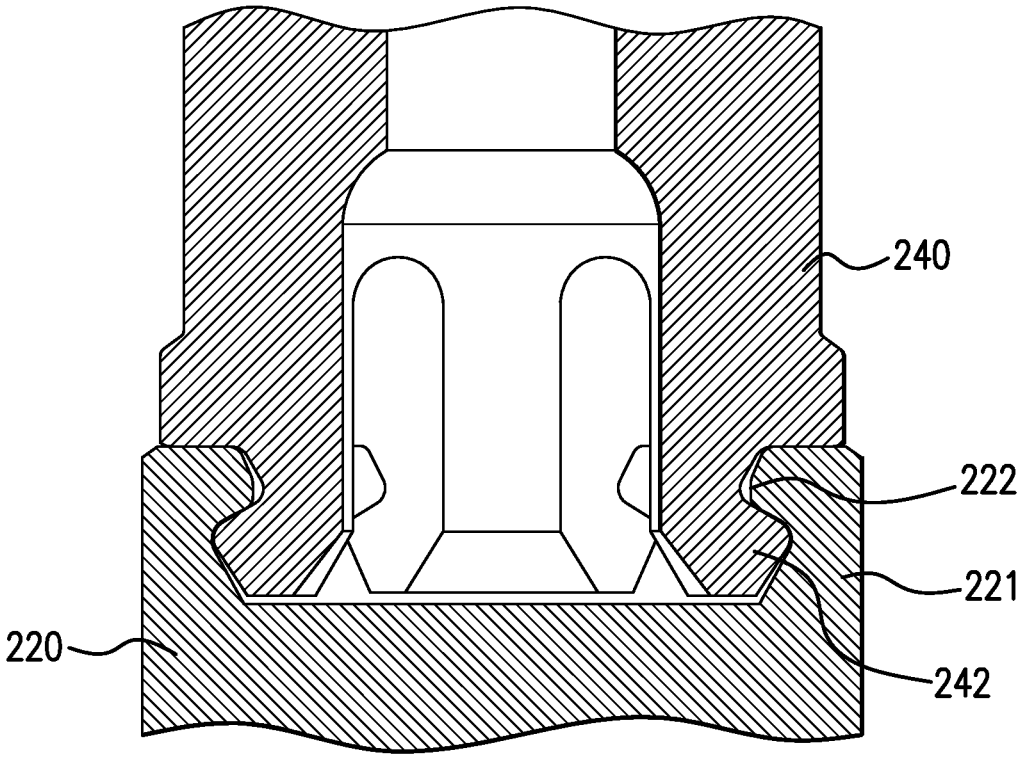
FIG. 2B depicts a cross-sectional view of a coupling used in the embodiment of FIG. 2A.

As noted above, the bone conduction device 100 is configured such that the operationally removably component 290 is removably attached to the implant 201. This is accomplished via a coupler, a portion of which is included in the bone conduction implant 201, and a portion of which is included in the operationally removable component 290 (e.g., coupling apparatus 240). In an exemplary embodiment, the operationally removable component 290 snap-couples to the abutment 220. FIG. 2B depicts a snap-coupling arrangement utilized with the coupling apparatus 240, although some elements of the bone conduction device 100 are not shown for clarity. More particularly, FIG. 2B depicts a close-up view of the interface between the abutment 220 and the coupling apparatus 240. As may be seen, abutment 220 includes a recess formed by sidewall 221 that has an overhang 222 that interfaces with corresponding teeth 242 of coupling apparatus 240. Teeth 242 elastically deform inward upon the application of sufficient removal and/or installation force to the coupling apparatus 240. In an exemplary embodiment, element 220 can correspond to any abutment herein and variations thereof providing that it includes the snap-coupling arrangement and variations thereof.

It is noted that while the male component is depicted as being a part of the coupling apparatus 240 and the female component is depicted as part of the abutment, in other embodiments, this can be reversed. It is noted that the coupling arrangement of FIGS. 2A and 2B can be used with any of the embodiments of the adapters detailed herein, some examples of such use being detailed below.

In the embodiment of FIGS. 2A and 2B, the connection between the coupling apparatus 240 and the abutment 220 is such that vibrations generated by the operationally removable component 290 (e.g., such as those generated by an electromagnetic actuator and/or a piezoelectric actuator, etc.) in response to a captured sound are effectively communicated to the abutment 220 so as to effectively evoke a hearing percept, if not evoke a functionally utilitarian hearing percept. Such communication can be achieved via a coupling (sometimes referred to herein as a connection) that establishes at least a modicum of rigidity between the two components. In this vein, the dimensions and/or geometries of the interfacing portions are, in at least some embodiments, such that they can be varied in only minor ways while still achieving the utilitarian functionality of the bone conduction device. Put another way, the design of the abutment 220 is such that it will utilitarianly interface with a limited number of designs of coupling apparatus 240. That is, coupling apparatuses of different designs may not utilitarianly couple to the abutment 220, yet there can be utility in coupling removable components having such coupling apparatuses of different designs to the abutment 220. With this in mind, it is noted that there is utilitarian value in not removing the abutment 220 from the recipient, such as, for example, in the case where the abutment is integrated to skin of the recipient.

As may be seen from FIGS. 2A and 2B, the abutment 220 forms a female portion of the coupling of the bone conduction device 100, and the coupling apparatus 240 forms a male portion of the coupling. Some operationally removable components different from component 290 have coupling portions that are female instead of male, and thus are generally incompatible for coupling directly to the abutment 220. An exemplary embodiment provides an adapter that is configured to enable coupling of such an operationally removable component to the abutment 220, as will now be described.

Figure 3A:
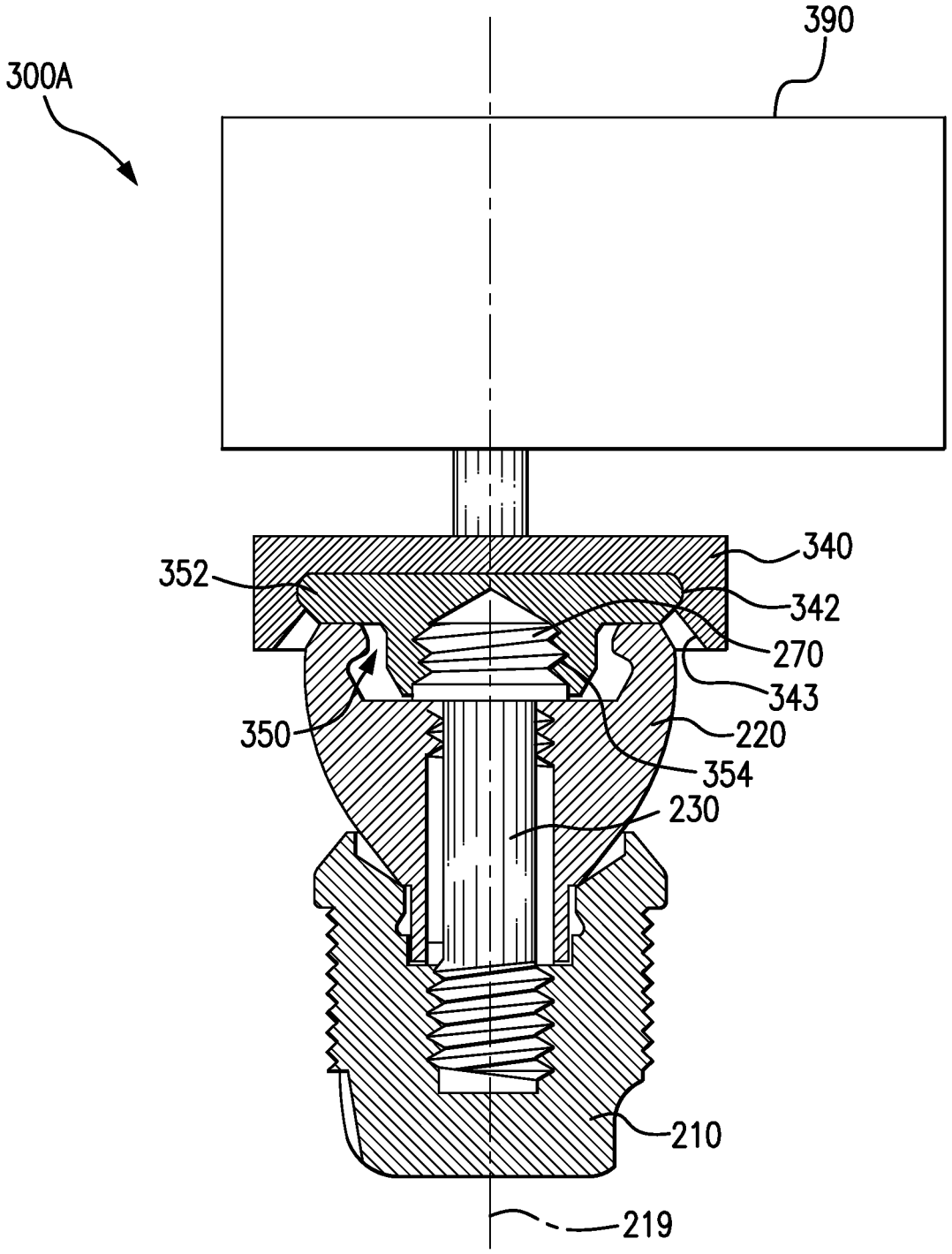
FIG. 3A depicts a side view of another exemplary bone conduction device according to an embodiment.

FIG. 3A depicts an exemplary bone conduction device 300A including fixture 210 and abutment 220 held thereto with an abutment screw 230, the abutment screw 230 being of the type that has male threads about the screw head 270. Bone conduction device 300A includes an operationally removable component 390 having a coupling apparatus 340 with a female connector portion, this portion being incompatible with the abutment 220 at least with respect to establishing a coupling to effectively conduct vibrations from the removable component 390 to the abutment 220.

The bone conduction device 300A includes an adapter 350 attached to the abutment screw 230. More specifically, the adapter 350 includes a male portion 352 attached to bore 354. Bore 354 includes female threads that interface with the male threads of the abutment screw head 270, thereby fixedly connecting the adapter 350 thereto. In some embodiments, the threads of the bore 354/screw head 270 have such direction that the torque applied to the adapter 350 to screw the adapter onto the screw head 270 is in the same direction as the torque applied to the abutment screw 230 to tighten the abutment 220 to the fixture. Accordingly, tightening the adapter 350 to the abutment screw 230 will not reduce the clamping force between the abutment 220 and the fixture 210. In other embodiments, the threads can be the opposite of this.

In an exemplary embodiment, the adapter 350 is sized and dimensioned such that it can be finger tightened onto the screw head 270 by at least about the $50^{th}$ percentile human factor female and/or male U.S. citizen 18 to 40 years old in a manner sufficient to provide utility as detailed herein and/or variations thereof.

Accordingly, FIG. 3A presents a prosthesis structural component comprising and an adapter 350 that is configured to indirectly couple a coupling apparatus 340 of an operationally removable component 390 of a bone conduction device to a coupling apparatus of a body interfacing prosthesis (abutment 220).

In the embodiment of FIG. 3A, the adapter is sized and dimensioned such that the adapter 350 can be screwed down towards the abutment 220 until the bottom of the male portion 352 bottoms out on the end face of the abutment 220. In an alternate embodiment, the adapter is sized and dimensioned such that the adapter 350 can be screwed down towards the abutment 220 until the bottom of the bore 354 bottoms out on the screw head 270 and/or on the interior portion of the abutment 220. Continued torque will tighten the adapter 350 to the abutment 220. The clamping force between the two components can be such that it fixes the adapter 350 to the abutment 220. Thread locking compound can also or instead be applied to the threads of the bore 354 and/or screw head 270 to fix the adapter 350 to the bone abutment screw 230. Any configuration, system and/or method that will enable the adapter 350 to be fixed or otherwise connected to the abutment and/or abutment screw can be utilized in some embodiments so that the embodiments detailed herein and/or variations thereof can be practiced.

Male portion 352 can be in the form of a circular plate with chamfered edges, although as detailed below, other configurations can be utilized. In this regard, FIG. 3A depicts cross-sectional views of the bone fixture 210, the abutment 220, the adapter 350 and a portion of the coupling apparatus 340. The adapter 350 is rotationally symmetric about axis 219 (the longitudinal axis of the abutment 220), save for the female threading, which is spiralled about the axis, although in other embodiments this is not the case/the adapter 350 is rotationally symmetric about an axis of another component.

Figure 3B:
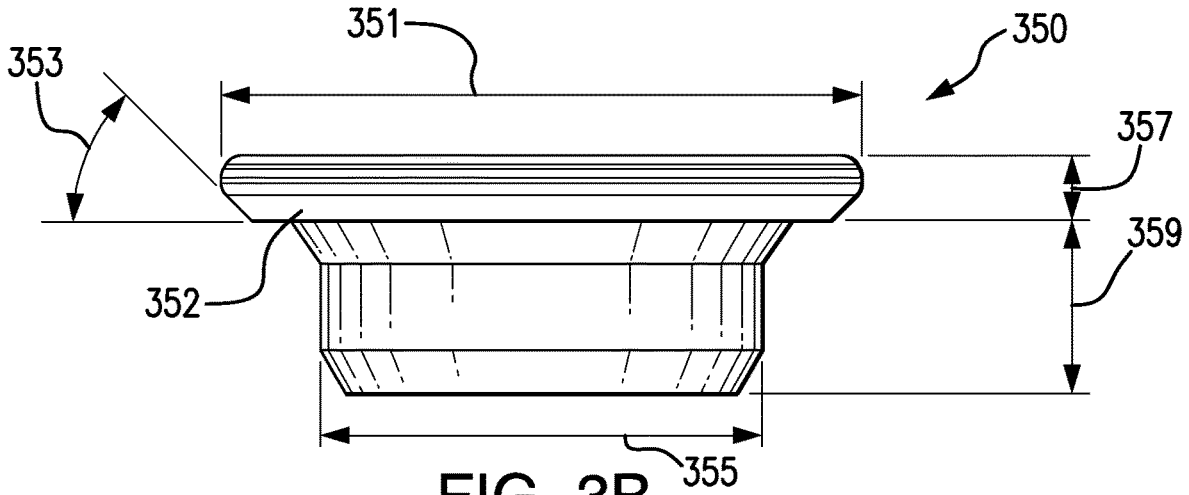
FIGS. 3B-3D depict additional features of the adapter of FIG. 3A.

FIG. 3B depicts adapter 350 without depiction of the abutment and the operationally removable component 390, where reference dimension 351 is, in an exemplary embodiment, 7.4 mm in diameter and/or any other value within the range of values of about 4.0 mm to about 15 mm in 0.1 mm increments. Reference dimension 353 is, in an exemplary embodiment, 45 degrees and/or any other value within the range of values of about 10 degrees to about 70 degrees in 1 degree increments. Reference dimension 355 is, in an exemplary embodiment, 5.1 mm in diameter and/or any other value within the range of values of about 2.0 mm to about 12 mm in 0.1 mm increments. Reference dimension 357 is, in an exemplary embodiment, 0.75 mm in length and/or any other value within the range of values of about 0.1 mm to about 3 mm in 0.1 mm increments. Reference dimension 359 is, in an exemplary embodiment, 2.00 mm in height and/or any other value within the range of values of about 0.5 mm to about 5 mm in 0.1 mm increments.

Figure 3C:
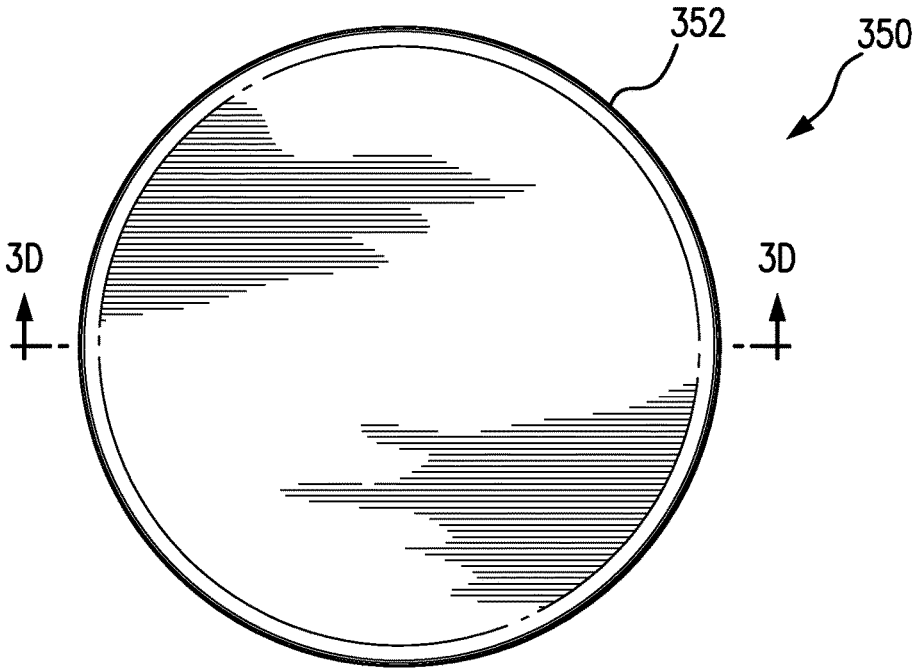
Figure 3D:
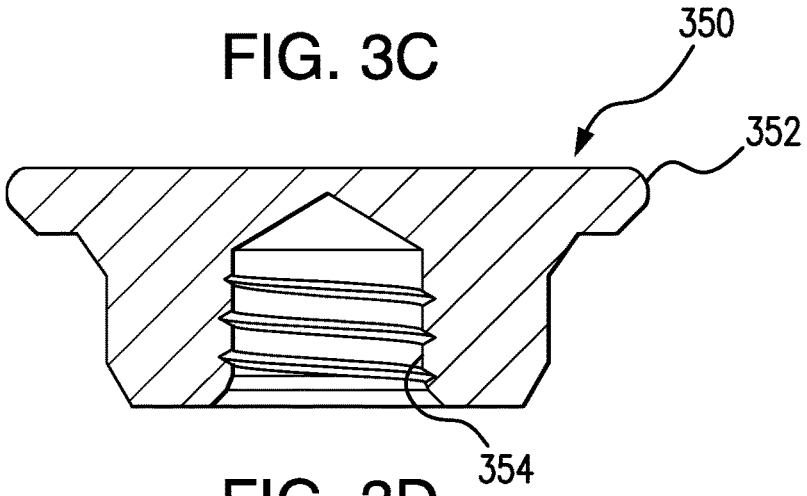

FIG. 3C depicts a top view of the adapter 350. As may be seen, it has a circular outer periphery. FIG. D depicts a cross-sectional view of section D-D of FIG. 3C, depicting the female threads of the adapter 350. The female threads of bore 354 are M2.5-6H, although in other embodiments other threads sizes can be used, at least with respect to providing utility in interfacing with the male threads of screw head 270. As noted, some embodiments do not have such screw threads (e.g., the bore is smooth).

The male portion 352 is configured to snap-couple into the female portion 342 of coupling apparatus 340 in a manner effectively analogous to and/or the same as the way the coupling portions snap-couple in the embodiment of FIGS. 2A-2B, except in reverse, thereby releasably coupling the coupling apparatus 340 to the adapter 350. That is, the female portion 342 is moved relative to/about the male portion 352 to achieve the snap-couple, whereas in the embodiment of FIGS. 2A-2B, it is the male portion that is moved relative to/about the female portion, owing to the fact that the abutment is attached (indirectly, although in other embodiments, it can be attached directly) to the skull bone 136. In an exemplary embodiment, the adapter 350 and the coupling apparatus 340 are configured to quick release and quick connect from and to, respectively, one another.

As noted above, the male portion 352 is in the form of a plate. The male portion 352 can have chamfered and/or rounded edges to facilitate the snap-couple into the female portion 342. Alternatively or in addition to this, the female portion can have chamfered and/or rounded edges to facilitate the snap-couple of the male portion 352 into the female portion 342. Any geometry that will enable the teachings herein and/or variations thereof to be practiced can be utilized in at least some embodiments.

In an exemplary embodiment, the interfacing geometry of the male portion 352 can correspond to that of the teeth 242 of FIG. 2B, and the interfacing geometry of the female portion 342 can correspond to the recess formed by sidewall 221 of FIG. 2B. In an exemplary embodiment, the male portion 352 can be segmented, akin to the teeth 242 of FIG. 2B. Indeed, in an exemplary embodiment, the functionality and/or geometry of the configuration of the embodiment of FIG. 3A is effectively identical to that of FIG. 2B, except in reverse. In this regard, it is noted that the geometry depicted in FIG. 3A is conceptual, and the exact implementation of the embodiment of FIG. 3A can vary providing that such variation has utility according to the teachings detailed herein and/or variations thereof.

According to the embodiment of FIG. 3A, by including the adapter 350 in the bone conduction implant 201, an operationally removable component having a coupling apparatus of a design effectively different from that depicted in FIG. 2A can be attached to the bone conduction implant while using the same abutment/without having to remove the abutment and replace it with a different abutment that is compatible with that different removable component. Such can enable the effective conduction of vibrations from the removable component 390 to the abutment 220 to effectively evoke a hearing percept, if not evoke a functionally utilitarian hearing percept.

In an exemplary embodiment, the bone conduction device 300A of FIG. 3A is configured such that the coupling apparatus 340 will uncouple from the adapter 350 upon the application of a force in a direction normal to the longitudinal axis 219 of the abutment 220 away from the abutment 220 of about 1, 2, 3, 4, 5, 6, 7, 8, 9, 10, 11 and/or 12 Newtons and/or more and/or any value or range of values between any of those values in 0.1 Newton increments (e.g., 1.5 Newtons, 5.3 to 10.1 Newtons, etc.). In an exemplary embodiment, this force is about 30, 35, 40, 45, 50, 55, 60, 65, 70, 75, 80, 85, 90, 95, 100, 105, 110, 115, 120, 125, 130, 135, 140, 145, 150, 155, 160 and/or 165% and/or more and/or any value or range of values between any of those values in about 1% increments of the force at which the coupling apparatus 290 releases from the abutment 220 when directly attached thereto.

In an exemplary embodiment, the bone conduction device 300A is configured such that the aforementioned removal forces are applied to the adapter 350 without the adapter 350 becoming disconnected from the abutment 220. In an exemplary embodiment, the force applied to the adapter 350 in the same direction to disconnect the adapter 350 from the abutment 220 is about 125, 130, 135, 140, 145, 150, 155, 160, 170, 180, 190, 200, 220, 240, 260, 280, 300, 350, 400% and/or more and/or any value or range of values between any of those values in about 1% increments of the force at which the coupling apparatus 290 releases from the abutment 220 when directly attached thereto.

As may be seen from FIG. 3A, the coupling apparatus 340 contacts the adapter 350 and does not contact the abutment 220. Accordingly, vibrations from the operationally removable component 390 are first transferred into the adapter 350 and then into the abutment 220. Accordingly, in an exemplary embodiment, at least about 100% of the vibrational energy that is generated by the operationally removable component 390 and that passes into the fixture 210 via the bone conduction implant is at some point transferred into the adapter 350, and, in an exemplary embodiment, at least about 100% of that energy first is transferred into the adapter 350 before being transferred into the abutment 220. Further, in an exemplary embodiment, at least about 100% of the vibrational energy that is generated by the operationally removable component 390 and that passes into the fixture 210 via the bone conduction implant is at some point transferred into the abutment 220, but after at least about 100% of that energy is first transferred into the adapter 350.

In an alternate embodiment, the coupling apparatus 340 contacts the adapter 350 and also contacts the abutment 220. Such an exemplary embodiment can result from a design where there exists an interference fit between the inner lip 343 of the coupling apparatus 340 and the outer circumference of abutment 220. Accordingly, a portion of the vibrational energy from the operationally removable component 390 is transferred into the adapter 350 and a portion of the vibrational energy from the component 390 is transferred into the abutment 220 (such can be transferred effectively simultaneously, in some embodiments). Accordingly, in an exemplary embodiment, a first percentage less than 100% of the vibrational energy that is generated by the operationally removable component 390 and that passes into the fixture 210 via the bone conduction implant is at some point transferred into the adapter 350. Further, in an exemplary embodiment, a second percentage less than 100% of the vibrational energy that is generated by the operationally removable component 390 and that passes into the fixture 210 via the bone conduction implant is at some point transferred into the abutment 220. In an exemplary embodiment, the ratio of the first percentage to the second percentage can be about 50, 30, 20, 10, 5, 1, 0.2 0.1, 0.5, 0.01 0.02, 0.03 or any value or range of values therebetween (e.g., between about 20 and about 0.2).

As noted above, the connection between the adapter 350 and the abutment 220 is rigid. It is sufficiently rigid such that vibration transfer from the coupling apparatus 340 to the abutment 220 is such that vibrations transferred to the abutment 220 from the operationally removable component 390, either partially or fully through the adapter 350 or by bypassing the adapter (i.e., the adapter is effectively utilized to hold the coupling apparatus 390 rigidly to the abutment 220), in response to a captured sound, are effectively communicated to the abutment 220 so as to effectively evoke a hearing percept, if not evoke a functionally utilitarian hearing percept. In an exemplary embodiment, the adapter 350 is configured such that the difference between the vibrational energy transferred into the adapter 350 (i.e., from the operationally removable component 390) and the vibrational energy transferred into the abutment 220 from the adapter 350 as a result of the transfer of the vibrational energy into the adapter 350 when the adapter 350 is rigidly connected to the abutment 220 is less than about 20 dB, 15 dB, 10 dB, 9 dB, 8 db, 7 dB, 6 dB, 5 dB, 4 dB, 3 dB, 2 dB, 1 dB, 0.5 dB, 0.25 dB 0.125 dB and/or 0.0 dB, or any value or range of values between any two of these values (e.g., between 15 dB and 0.0 dB).

Further, it is noted that the releasable coupling between the coupling apparatus 340 and the adapter 350 forms a rigid system. It is sufficiently rigid such that vibration transfer from the coupling apparatus 340 to the adapter is such that vibrations transferred to the adapter 350 from the operationally removable component 390 and then to the abutment 220 in response to a captured sound are effectively communicated to the abutment 220 so as to effectively evoke a hearing percept, if not evoke a functionally utilitarian hearing percept. In an exemplary embodiment, the adapter 350 is configured such that the difference between the vibrational energy transferred into the adapter 350 (i.e., from the operationally removable component 390) and the vibrational energy transferred into the coupling apparatus from the vibrator of the operationally removable component 390 when the coupling apparatus 340 is releasably coupled to the adapter 350 is less than about 20 dB, 15 dB, 10 dB, 9 dB, 8 db, 7 dB, 6 dB, 5 dB, 4 dB, 3 dB, 2 dB, 1 dB, 0.5 dB, 0.25 dB 0.125 dB and/or 0.0 dB, or any value or range of values between any two of these values (e.g., between 15 dB and 0.0 dB).

It is also noted that the above-mentioned performance features are applicable to, in some embodiments, any of the embodiments detailed herein and/or variations thereof, providing that the teachings detailed herein and/or variations thereof can be practiced in a utilitarian manner.

Figure 3E:
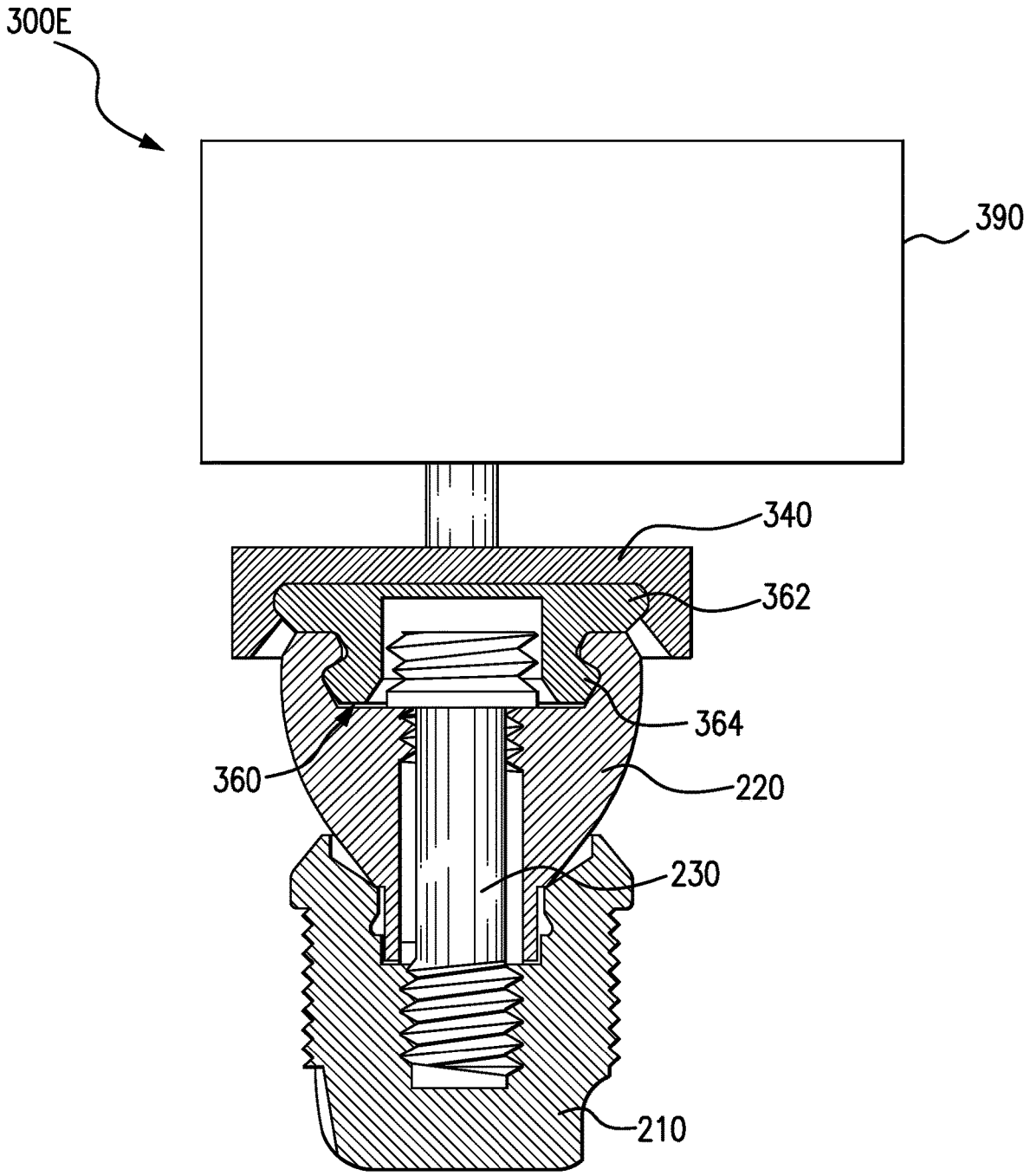
FIG. 3E depicts a side view of another exemplary bone conduction device according to an embodiment.

It is noted that while the embodiments of FIG. 3A utilizes the screw head 270 of the abutment screw 230 to attach the adapter 350 to the bone conduction implant, other adapter configurations can utilize other connection regimes. For example, as noted above, the abutment 220 is configured to snap-couple with the coupling apparatus 240. In this vein, FIG. 3E depicts an adapter 360 that snap-couples into the abutment 220. More particularly, FIG. 3E depicts another exemplary bone conduction device 300E which is identical to bone conduction device 300A save for the absence of adapter 350 and the presence of adapter 360, some of the features of which will now be detailed. Unlike adapter 350, which is attached to the abutment screw 230, adapter 360 is directly attached to the abutment 220 via a snap-couple. That is, the adapter 360 does not utilize the abutment screw 230 to secure the adapter to the implant. Instead, the adapter 360 is attached to the implant in a manner that is analogous to and/or the same as how the operationally removable component 290 is secured to the implant 201 in the embodiment of FIGS. 2A and 2B. Such an embodiment can have utilitarian value when used with bone conduction implants that do not include an abutment screw 230 that has the male threads about the head 270, even though such is depicted in FIG. 3E. It is noted that some embodiments can also include the attachment mechanism of FIG. 3A. That is, the adapter can be attached via screwing and snap-coupling (threads can be located on the inside of male portion 364). As noted above, any device, system and/or method that can attach the adapter to the implant can be utilized in some embodiments providing that the teachings detailed herein and/or variations thereof can be practiced.

Accordingly, adapter 360 includes a male portion 362 attached to a male portion 364. Male portion 362 can be similar to and/or substantially the same as (as used herein, "substantially the same," includes the same—all elements predicated by the term "substantially," "generally," "about", etc., include the element without such predication, unless otherwise noted) male portion 352 of adapter 350 in structure and/or function, at least with respect to the portions that interface with the coupling apparatus 340. Male portion 364 can be similar to and/or substantially the same as teeth 242 in structure and/or function, at least with respect to the portions that interface with the abutment 220. In an exemplary embodiment, the adapter 360 can be considered as two working ends of coupling apparatus 240 back-to-back and opposite one another, albeit one (the one that interfaces with the coupling apparatus 340) can be sized and dimensioned to interface with the female portion 342 of coupling apparatus 340, which can be of a different geometry than the female portion of the abutment 220.

It is noted that FIG. 3E depicts cross-sectional views of the bone fixture 210, the abutment 220, the adapter 360 and a portion of the coupling apparatus 340. The adapter 360 is rotationally symmetric about axis 219 (the longitudinal axis of the abutment 220), although in other embodiments this is not the case/the adapter 360 is rotationally symmetric about an axis of another component.

An exemplary embodiment of the bone conduction device 300E having utility is such that the removal force associated with detaching the operationally removable component 390 from the adapter 360 is less than that associated with detaching the adapter 360 from the abutment. (This is also the case with respect to the adapter 350 detailed above, although owing to the threads of the bore 354, if such was not the case, the adapter 350 and/or the abutment screw 230 can, in some embodiments, experience plastic deformation of at least a portion thereof.) That is, in an exemplary scenario where a recipient to the bone conduction device 300E seeks to remove the operationally removable component 390 from the implant, the adapter will remain on the abutment 220 instead of being pulled of the abutment with the operationally removable component 390. Accordingly, the adapter can be considered part of the bone conduction implant.

Such utility can also be achieved by, for example, making the male portion 352 more ductile than the male portion 364. Such can be achieved in some embodiments by applying different heat treatments to the portions. Such can also be achieved in some embodiments by utilizing different materials for the different portions. In this regard, while the embodiment of the adapter 360 depicted in FIG. 3E is a monolithic component, the male portion 362 and the female portion 364 can be made of different components and attached together (e.g., via screw thread, cross-bolt, welding, etc.) In embodiments utilizing teeth (such as the teeth of FIG. 2B), such utility can be achieved by, for example, providing fewer teeth on the male portion 362 than on the male portion 364, where the teeth are substantially geometrically identical. Such utility can be achieved by, for example, by providing teeth in the male portion 362 having a radial dimension (e.g., arc length of outer perimeter opposite the female portion 342) that is less than that of teeth on the male portion 364 (i.e., the spacing between the teeth can be greater on the male portion 364). That said, such utility can also be achieved utilizing a solid (non-toothed) embodiment by dimensioning the pertinent features in such a manner.

The aforementioned utility regarding adapter 360 retention to abutment 220 can be obtained through the use of a male portion 362 having different female component interfacing geometries than the male portion 364. For example, the rounded portions of the male portion 362 that snap-couple above the protruding portions of the female section of coupling apparatus 340 can have an effective radius that is less than that of the corresponding portions of male portion 364 relative to the female portion of abutment 220. (Effective radius is a dimensionless radius normalized to address the corresponding features of the female component, thereby permitting apples to apples comparison of the two radii.) The amount of material that need be elastically deformed in the male portion 362 can be less than the amount of material in the male portion 364. Any device, system and/or method that will enable the adapter 360 to stay attached to the abutment 220 instead of the coupling apparatus 340 when the operationally removable component 390 is removed from the implant during at least normal operational removal can be utilized in some embodiments providing that the teachings detailed herein and/or variations thereof can be practiced.

It is noted that while some of the aforementioned features and some of the features below are described in terms of design processes and/or manufacturing processes (e.g., "providing fewer teeth," etc.), it is to be understood that all teachings detailed herein and/or variations thereof relating to design processes and/or manufacturing processes also convey the resulting design of a bone conduction device and the resulting manufactured bone conduction device that has the features resulting from processes (e.g., a bone conduction device with "fewer teeth").

While not explicitly depicted in the FIGs., an alternate embodiment can include an adapter sized, dimensioned and constructed of material such that when subjected to an effectively low temperature, the adapter contracts such that it fits into the female portion of the abutment 220 via a clearance fit, slip fit and/or a relatively significantly reduced interference fit. By way of example, the adapter can be bathed in a mixture of isopropyl alcohol and dry ice or a cryogenic substance available at medical facilities. Such bathing will cause the pertinent dimensions of the adapter to shrink, thereby obtaining the aforementioned fit. Upon the intake of thermal energy to return the adapter to about room temperature, the adapter will expand and, depending on the configuration of the abutment and the adapter, the adapter will be effectively rigidly attached to the abutment. Heat conveying media can be utilized to ensure that the abutment and/or bone fixture remain at a sufficient temperature such that heat transfer from the surrounding tissue is limited to a level that does not have at least a significant deleterious result.

It is noted that an alternate embodiment includes an adapter corresponding to that detailed in FIG. 3A and/or FIG. 3F below, except there is no female threads in the bore. Further, there are no male threads to interface with on the screw head of the abutment screw 230. In a reversal of that detailed above, the adapter can be heated to a temperature such that the diameter of the bore expands such that it fits over the screw head 270 of the abutment screw 230 via a clearance fit, slip fit and/or a relatively significantly reduced interference fit. By way of example, the adapter can be heated in an autoclave or non-industrial oven. Such heating will cause the pertinent dimensions of the adapter to expand, thereby obtaining the aforementioned fit. Upon the dissipation of thermal energy to return the adapter to about room temperature, the bore of the adapter will contract about the screw head, and depending on the configuration of the adapter and the screw head, the adapter will be effectively rigidly attached to the screw head. Heat transfer can be managed so as to avoid imparting a substantially deleterious amount of thermal energy into the recipient.

The two procedures (cooling and heating) can result in an adapter that is, for all intents and purposes, unremovable from the implant without removing the mating component (abutment and/or abutment screw). Further, even in the case of the adapters of FIGS. 3A and 3E, circumstances can exist where it is utilitarian to remove the abutment and/or abutment screw along with the adapter as opposed to attempting to remove the adapter with the abutment and/or bone screw in place. Accordingly, in an exemplary embodiment, the adapters can include a through hole that enables at least a portion of the top of the abutment screw to be accessed with a removal tool (e.g., enables access to the internal upper bore 272 that can form a unigrip, internal hex or multi-lobular configuration for a cooperating insertion tool). In embodiments where the adapter is attached to the abutment screw, the through hole might not be as large in diameter as the outer diameter of the head of the abutment screw, as removal of the abutment screw will remove the adapter. Conversely, in embodiments where the adapter is attached to the abutment, the through hole can be as large as and/or larger than the outer diameter of the head of the abutment screw, thereby enabling passage of the abutment screw therethrough during removal of the abutment screw (followed by subsequent removal of the abutment, which also results in the removal of the adapter from the recipient).

It is noted that in an exemplary embodiment, the adapters detailed herein and/or variations thereof can include mechanical elements that enable the use of attachment and/or removal tools to be used to attach and/or remove the adapter(s) from the abutments and/or the functionally operational component. By way of example, an exemplary adapter can include wrench flats or pry tabs to facilitate installation and/or removal.

Any device, system and/or method of attaching and/or removing the adapter from the bone conduction implant (including removal of the bone screw and/or abutment) can be utilized in some embodiments providing that at least some embodiments detailed herein and/or variations thereof can be practiced.

As with the embodiment of FIG. 3A, according to the embodiment of FIG. 3E, by including the adapter 360 in the bone conduction implant, an operationally removable component having a coupling apparatus of a design effectively different from that depicted in FIG. 2A can be attached to the bone conduction implant while using the same abutment/without having to remove the abutment and replace it with a different abutment that is compatible with that different removable component. Such can enable the effective conduction of vibrations from the removable component 390 to the abutment 220 to effectively evoke a hearing percept, if not evoke a functionally utilitarian hearing percept. Accordingly, in an exemplary embodiment, the adapter is configured to provide effective bone conduction vibrational coupling.

It is noted that while some features are detailed with respect to a given embodiment (e.g., the embodiment of FIG. 3E), embodiments include any one or more or all features detailed with respect to one embodiment and utilized in another embodiment providing that such inclusion into the another embodiment enables the teachings detailed herein and/or variations thereof to be practiced.

Figure 3F:
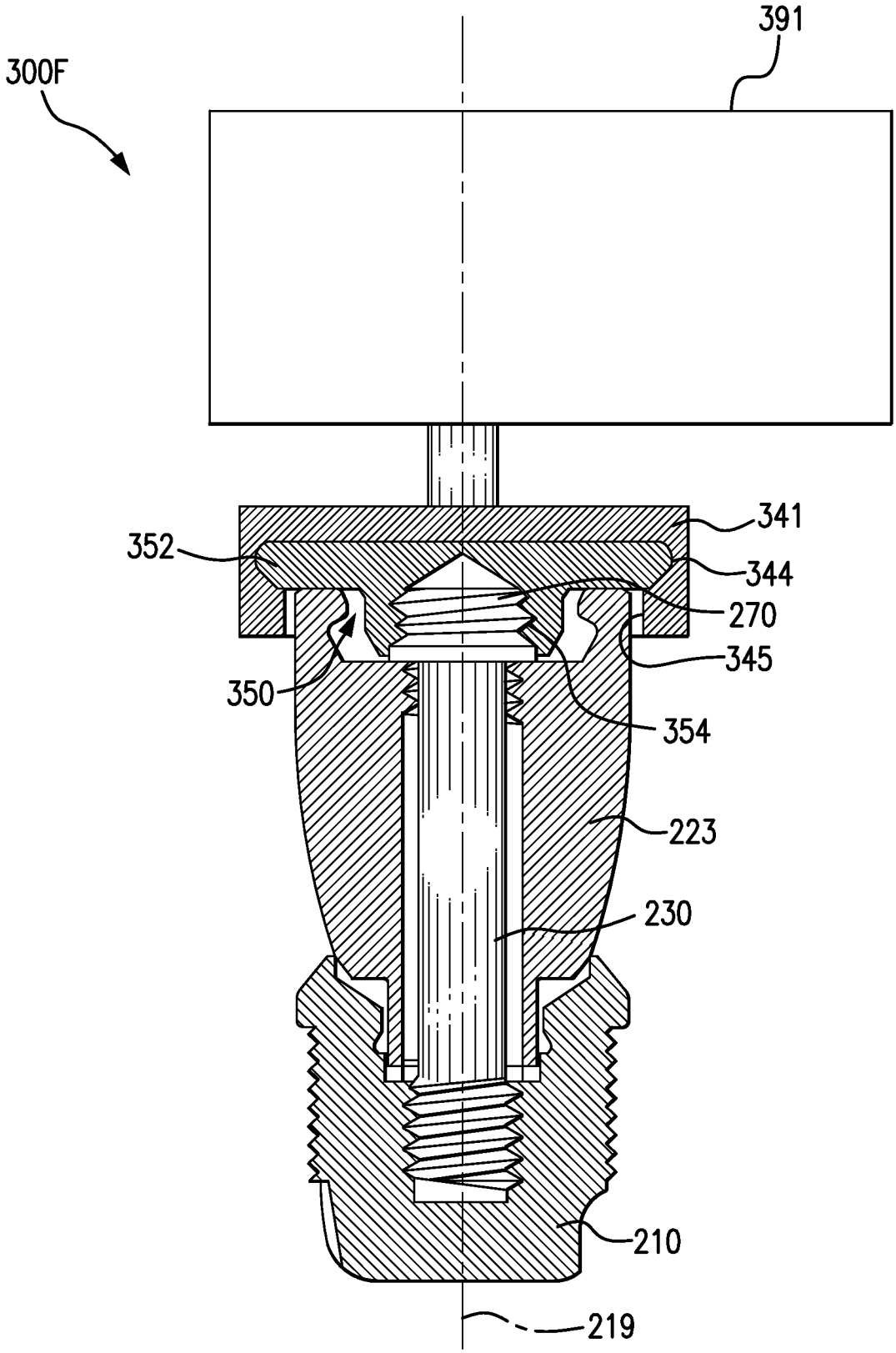
FIG. 3F depicts a side view of another exemplary bone conduction device according to an embodiment.

FIG. 3F depicts an alternate embodiment of an exemplary bone conduction device 300F having an abutment that is thinner than the embodiment of FIGS. 3A and 3E. Specifically, bone conduction device 300F includes fixture 210 and abutment 223 held thereto with an abutment screw 230. Abutment 223 is of a thinner, more slender configuration than the abutment 220, as may be seen (note FIG. 3F is not drawn to scale). Accordingly, the male portion 352 of the adapter 350 extends past the outer periphery of abutment 223, although FIG. 3F is conceptually representative of an alternative embodiment where the adapter has a male portion 352 that is more elongate in the lateral direction than the adapter of FIGS. 3A-3E.

While the operationally removable component 390 of FIGS. 3A and 3E can be used with the bone conduction implant of the embodiment of FIG. 3F, a different operationally removable component 391 can be used. As may be seen, component 391 includes a coupling apparatus 341 with a female connector portion, this portion being incompatible with the abutment 220 at least with respect to effectively conducting vibrations from the removable component 390 to the abutment 220. The female portion 344 of coupling apparatus 341 is configured to snap-couple to the adapter 350 in a manner effectively analogous to and/or the same as the way the coupling apparatus 340 snap-couples to adapter 350. However, as may be seen, sidewalls 345 extend further in the longitudinal direction and further inward toward the longitudinal axis 219 of the abutment 223. Because the abutment 223 is thinner and/or because the male portion 352 extends further in the lateral direction, the sidewalls 345 do not interfere with the abutment 223. Such an exemplary embodiment can have utility in providing more overlap and/or contact between the interfacing portions of the adapter and the coupling apparatus, thereby providing increased rigidity and/or vibrational conductivity as compared to the embodiments of FIGS. 3A and 3E.

Figure 4A:
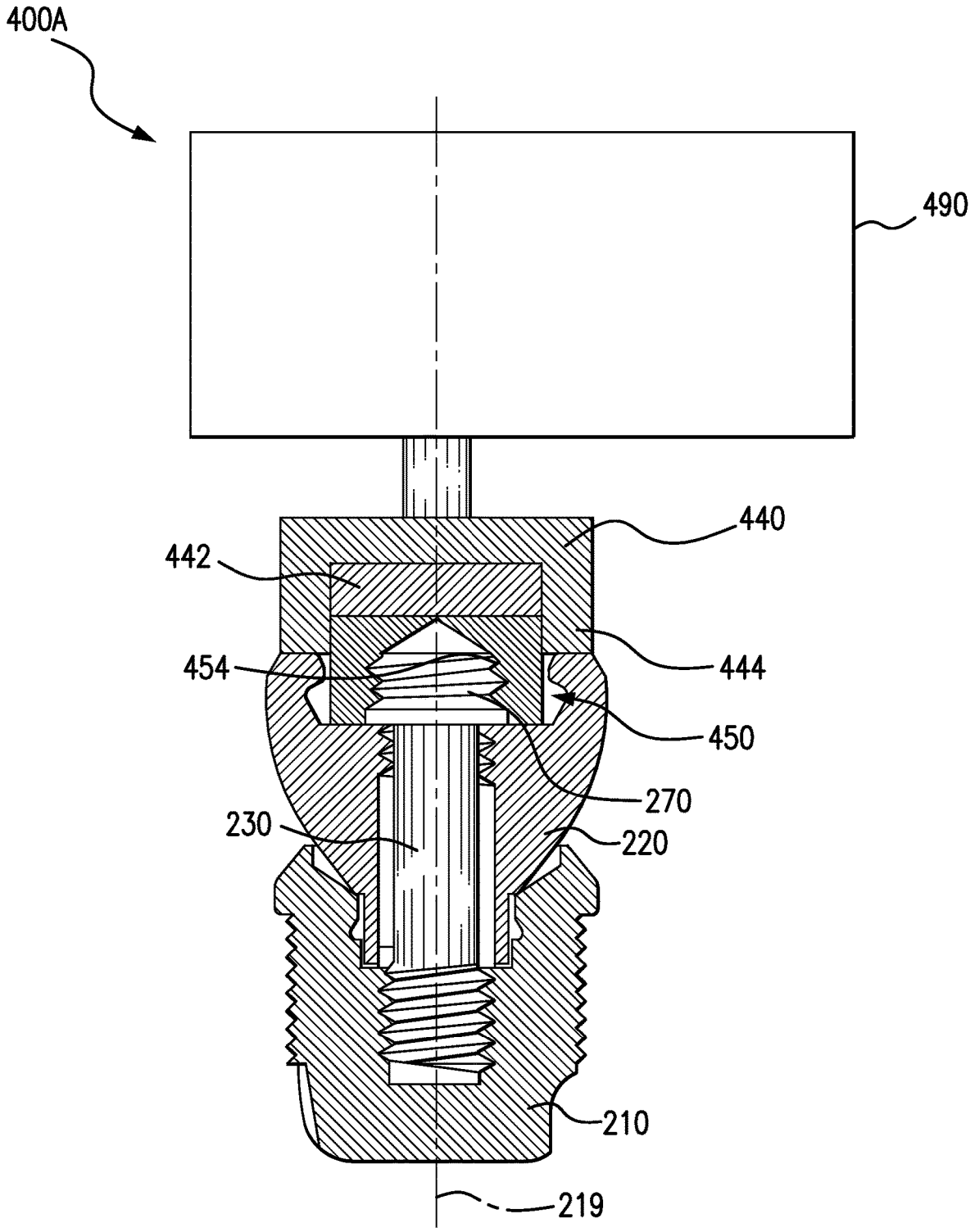
FIG. 4A depicts a side view of another exemplary bone conduction device according to an embodiment.

FIG. 4A depicts an alternate embodiment of an exemplary bone conduction device 400A including fixture 210 and abutment 220 held thereto with abutment screw 230, the abutment screw 230 being of the type that has male threads about the screw head 270. Bone conduction device 400A includes an operationally removable component 490 having a coupling apparatus 440 with a ferromagnetic mass 442, this portion being incompatible with the abutment 220, at least with respect to effectively conducting vibrations from the removable component 490 to the abutment 220.

The bone conduction device 400A includes an adapter 450 attached to the abutment screw 230. More specifically, the adapter 450 includes a ferromagnetic mass having a bore 454. Bore 454 includes female threads that interface with the male threads of the abutment screw head 270, thereby fixedly connecting the adapter 450 thereto in a manner similar to and/or the same as the threads of adapter 350 detailed above.

The adapter 450 can be screwed down towards the abutment 220 until the bottom of the adapter 450 bottoms out on the recessed portion of the abutment 220 and/or onto the head of the abutment screw. Continued torque will tighten the adapter 450 to the abutment 220. The clamping force between the two components can be such as to fix or otherwise connect the adapter 450 to the abutment 220.

FIG. 4A depicts cross-sectional views of the bone fixture 210, the abutment 220, the adapter 450 and a portion of the coupling apparatus 440. The adapter 450 is rotationally symmetric about axis 219 (the longitudinal axis of the abutment 220), although in other embodiments this is not the case/the adapter 350 is rotationally symmetric about an axis of another component. While the bore is depicted as only extending partially into the adapter 450, in an alternate embodiment, the bore passes completely through the adapter 450. The adapter 450 can be in the form of a monolithic cylinder made of a ferromagnetic material having a bore therein. Such can provide access to the internal internal upper bore 272 that can form the unigrip, internal hex or multi-lobular configuration for a cooperating insertion tool (i.e., the tool can fit through the bore).

In an exemplary embodiment, at least one of mass 442 and at least a portion of adapter 454 is a permanent magnet. It is noted that in some embodiments, instead of a mass 442 that is separate from other components of the coupling apparatus 440, the coupling apparatus can be made of a ferromagnetic material such that the teachings detailed herein and/or variations thereof can be practiced. Alternatively or in addition to this, a separate ferromagnetic mass can be included in adapter 450 (i.e., it is not monolithic). Moreover, a plurality of masses can be used in one or both elements. In an alternate exemplary embodiment, both mass 442 and at least a portion of the adapter 545 is a permanent magnet. In the former embodiment, the permanent magnet and the ferromagnetic material combination are such that the operationally removable component 490 can be removably coupled to the bone conduction implant in general and the abutment 220 in particular so as to support the operationally removable component 490 on the abutment 220 and so as to enable the effective conduction of vibrations from the removable component 490 to the abutment 220 to effectively evoke a hearing percept, if not evoke a functionally utilitarian hearing percept. In the latter embodiment, the permanent magnets are aligned with opposite polls adjacent one another and the combination is such that that the aforementioned removable attachment and conduction of vibrations is enabled. As may be seen, the coupling apparatus 440 includes sidewalls 444 that surround the ferromagnetic mass 442 and surround a portion of the adapter 450. In this regard, the sidewalls 444 are sized and dimensioned so as to provide a slip-fit or otherwise provide a snug fit between the sidewalls 444 and the apparatus 450 such that the sidewalls 444 effectively prevent lateral movement (i.e., movement normal to the longitudinal axis 219) of the coupling apparatus 440, and thus the operationally removable component 490, relative to the abutment 220 in general and the longitudinal axis 219 of the abutment 220 in particular. Accordingly, positive retention in the lateral direction (i.e., normal to the longitudinal axis of the abutment 220) is provided.

As may be seen, the bottoms of the sidewalls contact the top of the abutment 220. In an alternative embodiment, the sidewalls do not contact the top of the abutment 220. Also as may be seen, the tops and sides of the ferromagnetic mass 442 contacts the inside bottom and inside sides of coupling apparatus 440. In some alternative embodiments, one or more of these elements of the adapter 450 do not contact the corresponding elements of the coupling apparatus 440.

It is noted that the sidewalls 444 have utilitarian value with respect to alignment in instances where, for example, only one permanent magnet exists. Alternatively, in the case of two permanent magnets, the magnetic fields are such that the magnets self-align with one another, and while lateral movement is not prevented per se, the arrangement magnetically resists such movement. It is noted that the sidewalls 444 can be used in embodiments that also utilize two permanent magnets.

According to the embodiment of FIG. 4A, by including the adapter 450 in the bone conduction implant, an operationally removable component having a coupling apparatus of a design effectively different from that depicted in FIGS. 2A and/or 3A (e.g., a design that utilizes a magnetic coupling) can be attached to the bone conduction implant while using the same abutment/without having to remove the abutment and replace it with a different abutment that is compatible with that different removable component. This even though the abutment 220 and/or the abutment screw 230 is made of a non-ferromagnetic material (e.g., titanium). Such can enable the effective conduction of vibrations from the removable component 490 to the abutment 220 to effectively evoke a hearing percept, if not evoke a functionally utilitarian hearing percept.

Figure 4B:
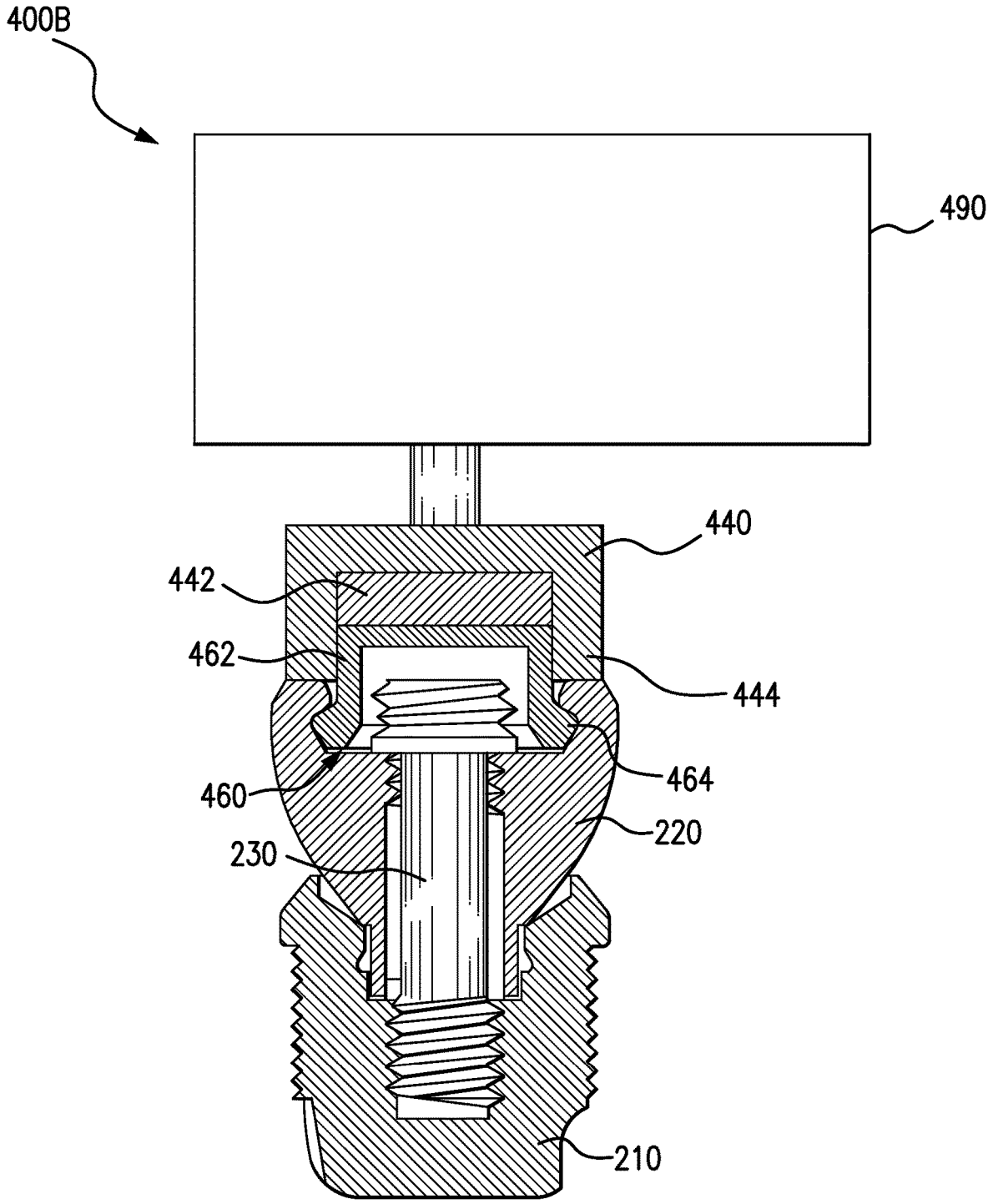
FIG. 4B depicts a side view of another exemplary bone conduction device according to an embodiment.

With the embodiment of FIG. 3E in mind vis-à-vis coupling of the adapter to the abutment, FIG. 4B provides an alternate embodiment of a bone conduction device 400B utilizing magnetic attraction to removably attach the operationally removable component 490 to the implant. More particularly, FIG. 4B depicts another exemplary bone conduction device 400B which is identical to bone conduction device 400A save for the absence of adapter 450 and the presence of adapter 460, some of the features of which will now be detailed.

Unlike adapter 450, which is attached to the abutment screw 230, adapter 460 is directly attached to the abutment 220 via a snap-couple in a manner analogous to and/or substantially the same as how adapter 360 is attached to abutment 220. Adapter 460 includes a ferromagnetic mass in the form of a male portion 462 linked to a male portion 464. While the geometry of the male portion 462 is depicted as being different from that of the male portion 362 of the adapter 360, male portion 464 can be similar to and/or substantially the same as the male portion 364 detailed above, providing that the coupling apparatus of the operationally removable component can interface therewith in accordance with at least some of the teachings detailed herein and/or variations thereof.

An exemplary embodiment of the bone conduction device 400B having utility is such that the removal force associated with detaching the operationally removable component 490 from the adapter 460 is less than that associated with detaching the adapter 460 from the abutment. (This is also the case with respect to the adapter 450 detailed above.) That is, in an exemplary scenario where a recipient to the bone conduction device 400B seeks to remove the operationally removable component 490 from the implant, the adapter will remain on the abutment 220 instead of being pulled of the abutment with the operationally removable component 490. Accordingly, the adapter can be considered part of the bone conduction implant.

Such utility can be achieved by, for example, varying the configuration of the male portion 464 such as by way of example as detailed above with respect to the variations of the configuration of the male portion 364 so that the force required to remove the adapter 460 from the abutment 220 is greater than that required to remove the operationally removable component 490 from the adapter 460 for a given magnetic attraction between the adapter 460 and the coupling apparatus 440. Alternatively or in addition to this, such utility can be achieved by varying the magnetic attraction between the ferromagnetic mass 442 and the ferromagnetic mass of the adapter 460 (at least one of which is a permanent magnet). Any device, system and/or method that will enable the adapter 460 to stay attached to the abutment 220 instead of the coupling apparatus 440 when the operationally removable component 490 is removed from the implant can be utilized in some embodiments providing that the teachings detailed herein and/or variations thereof can be practiced.

As noted above, the adapters detailed herein and/or variations thereof can be monolithic, or can be made of two or more assembled components. In this vein, an exemplary embodiment of the adapter 460 can include a male portion 462 that is made of a relatively hard/non-ductile material (e.g., a permanent magnet) and a male portion 464 that is made of a relatively ductile material. The portions can be separate components joined to one another as detailed herein (e.g., welded, screwed together, etc.), or the portions can be part of a monolithic component.

Figure 4C:
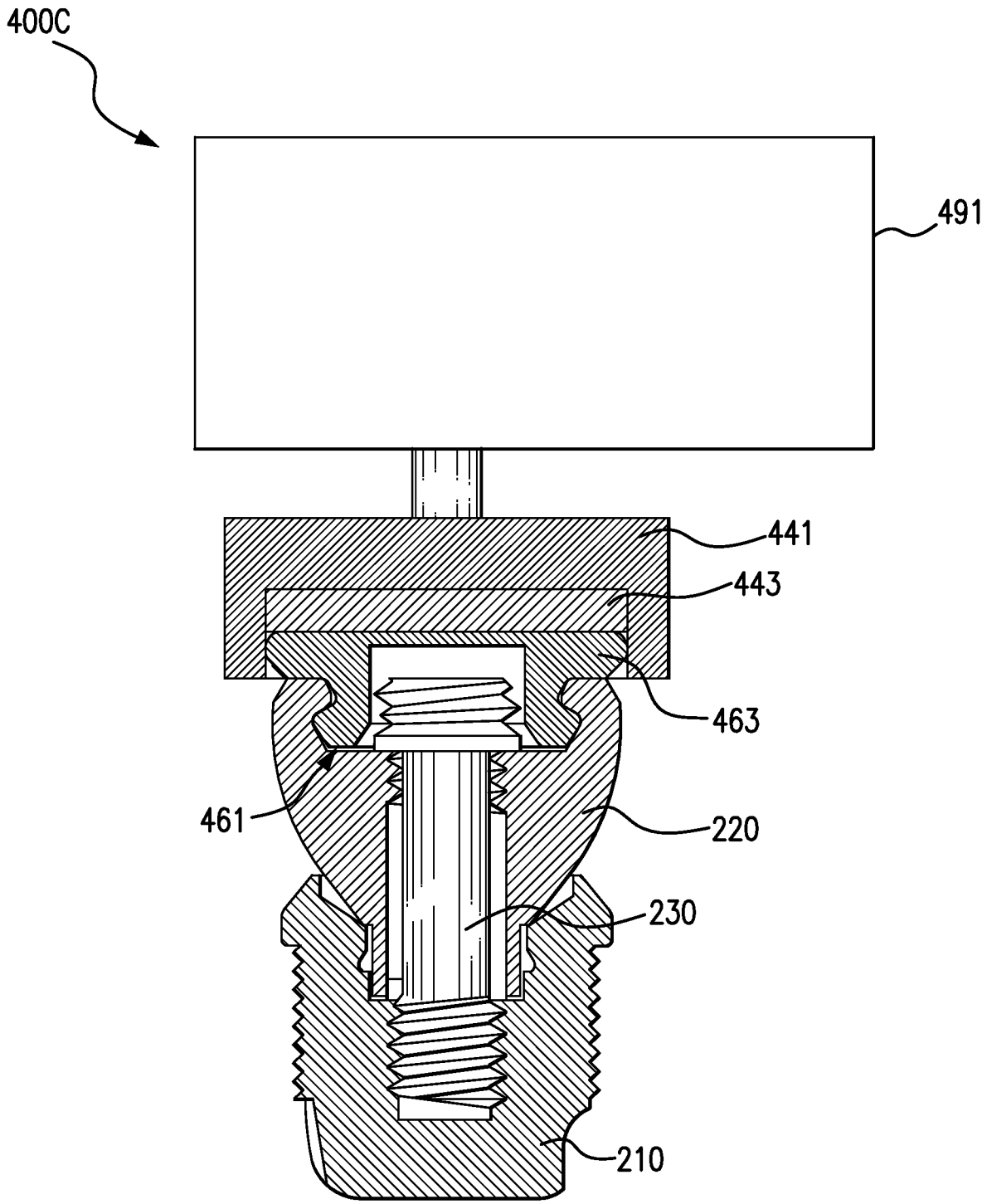
FIG. 4C depicts a side view of another exemplary bone conduction device according to an embodiment.

FIG. 4C depicts an alternate embodiment of a bone conduction device 400C, which parallels that of FIG. 4B in some respects, at least with respect to magnetic attraction, where the coupling apparatus 441 and magnet 443 of operationally removable component 491 are more elongated in the lateral direction (i.e., normal to the axis 219 of the abutment 220). The embodiment of FIG. 4C also details an adapter 461 that is identical to the adapter 460, except that the male portion 463 is also more elongated in the lateral direction. Specifically, as may be seen, male portion 463 extends from beyond the mouth of the female portion of abutment 220 to beyond the outer perimeter of the abutment 220. Put another way, the ferromagnetic material of the adapter 461 extends beyond an end of the abutment 220 in a direction parallel to the longitudinal axis 219 of the abutment 220.

It is noted that in an exemplary embodiment, the geometry of the portion below mass 443 of adapter 461 is identical to that of adapter 360 of FIG. 3E. In this regard, an exemplary embodiment includes retrofitting an adapter 360 to the configuration of adapter 460. Such an embodiment can include a method where a recipient is provided with an adapter 360 and a ferromagnetic mass 443, and can attach the mass 443 to the adapter 360 if the adapter is to be used with a magnetic coupling and detach the mass 443 if the adapter 360 is not to be used with a magnetic coupling/used with the coupling apparatus 340. In an alternate embodiment, there is an adapter can be identical in geometric shape and/or makeup to adapter 360 that enables the removable attachment of the operationally removable component 491 in a manner that provides the utilitarian features detailed herein and/or variations thereof. For example, the adapter 360 can be made of a ferromagnetic material. Such a configuration can also enable the removable attachment of the operationally removable component 390 in a manner that provides the utilitarian features detailed herein and/or variations thereof with the same adapter. That is, such geometry, accompanied with sufficient material properties, enable the adapter 360 to be utilized in the bone conduction device 400C. Because the coupling apparatus 441 is elongated as detailed above, it interfaces with the adapter 461 in a manner substantially the same as and/or analogous to the interface of the embodiments of FIGS. 3E and 4B.

In an alternate embodiment, an adapter for use with a magnetic coupling can have a geometry that is a compromise between that of adapter 360 and adapter 460 that enables the removable attachment of the functional removable components 390 and 490 in a manner that provides the utilitarian features detailed herein and/or variations thereof.

It is noted that the adapters detailed herein and/or variations thereof can be provided with a ferromagnetic component inboard of the adapter, with the remaining portions of the adapter being substantially similar to the adapters detailed herein not having such an inboard ferromagnetic component. By way of example, adapter 350 can include a ferromagnetic plate or ring centred about axis 219 but extending only to about the middle of the sidewalls 221 of the abutment 220. Alternatively or in addition to this, there can be adapters as detailed herein and/or variations thereof provided with a ferromagnetic component outboard of the adapter, again such as can be achieved by a ring or the like.

In the same vein, adapter 350 can be configured to have ferromagnetic materials so as to enable it to be used in bone conduction device 400C.

Figure 5A:
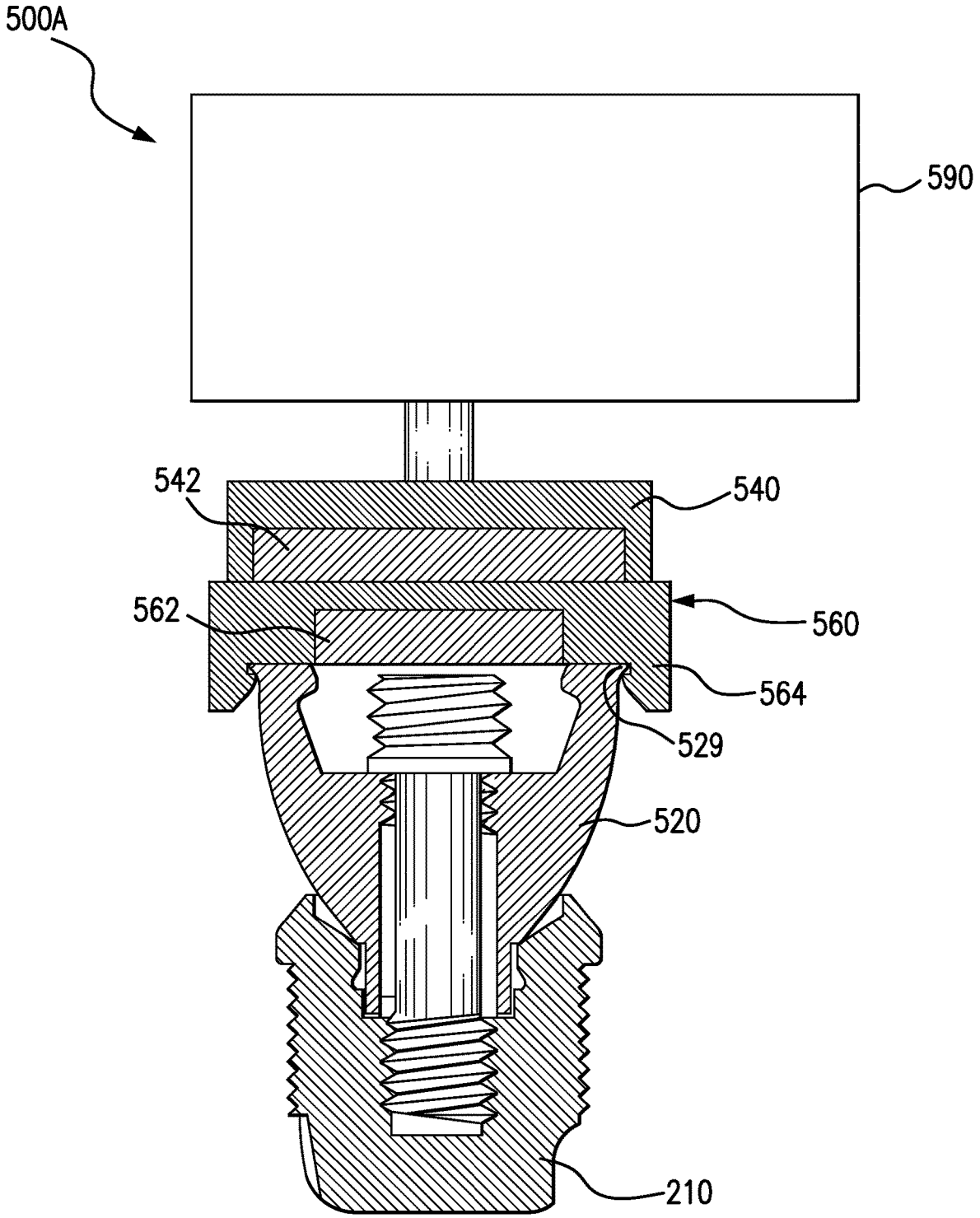
FIG. 5A depicts a side view of another exemplary bone conduction device according to an embodiment.

FIG. 5A depicts an alternate embodiment of an exemplary bone conduction device 500A including fixture 210 and abutment 520 held thereto with abutment screw 230. It is noted that abutment 520 is a variation of abutment 220 in that abutment 520 includes a portion 529 that flares outward, as may be seen, the utility of this to be discussed below. Bone conduction device 500A includes an operationally removable component 590 having a coupling apparatus 540 with a ferromagnetic mass 542, this portion being incompatible with the abutment 520 (or abutment 220), at least with respect to effectively conducting vibrations from the removable component 590 to the abutment 520 (or 220).

The bone conduction device 500A includes an adapter 560 attached to the abutment 520. More specifically, the adapter 560 includes a female portion having sidewalls 564 that interface with the flared portion 529 to snap-couple the adapter 560 to the abutment 520. In this regard, the adapter 560 includes a female component configured to receive therein an exterior perimeter of the abutment (e.g., the perimeter proximate the end of the abutment 520), the female component and the exterior of the abutment 520 being configured such that the receival releasably couples the adapter 560 to the abutment 520.

It is noted that the embodiment of the abutment 520 depicted in FIG. 5A is such that the coupling apparatus of the operationally removable component (not shown) configured to directly attach to the abutment 520 functions in an analogous manner and/or substantially the same as that of the adapter 560 to removably attach this different operationally removable component directly to the abutment 520. Accordingly, the adapter 560 permits operationally removable component 590 to be attached, indirectly, to the abutment 520, in place of the other operationally removable component.

The adapter 560 further includes ferromagnetic mass 562 that functions in a manner analogous to and/or substantially the same as the masses detailed above with respect to connection established via magnetic attraction. It is noted that in the embodiment depicted in FIG. 5A, both ferromagnetic mass 542 and ferromagnetic mass 562 are permanent magnets having their polarity opposite one another. This provides alignment, albeit magnetic alignment, and provides lateral retention, albeit magnetic lateral retention, at utilitarian levels that might not otherwise be achieved if only one of the masses were a permanent magnet. However, in an alternate embodiment, only one of the two masses is a permanent magnet, as the friction force between the coupling apparatus 540 and the adapter 560 is sufficiently, at least with respect to a sufficiently strong magnetic field, to provide utilitarian magnetic lateral retention.

In an alternate embodiment, sidewalls can be present that extend upward from the adapter 560 to provide positive lateral retention in a manner analogous to and/or substantially the same as the sidewalls 444 of the embodiment of FIG. 4A, as detailed above. In a converse vein, it is now noted that prior embodiments utilizing magnetic attraction can be practiced without the sidewalls 444, at least if using separate permanent magnets and/or if the friction force between the adapter and the coupling apparatus of the operationally removable component is sufficient to provide utilitarian magnetic retention in the lateral direction.

Centering of the coupling apparatus with the adapter can be achieved via the sidewalls taught herein and/or via a nub or alignment prong, etc. Alternatively, a recipient can feel whether the coupling apparatus is sufficiently centered on the adapter.

Figure 5B:
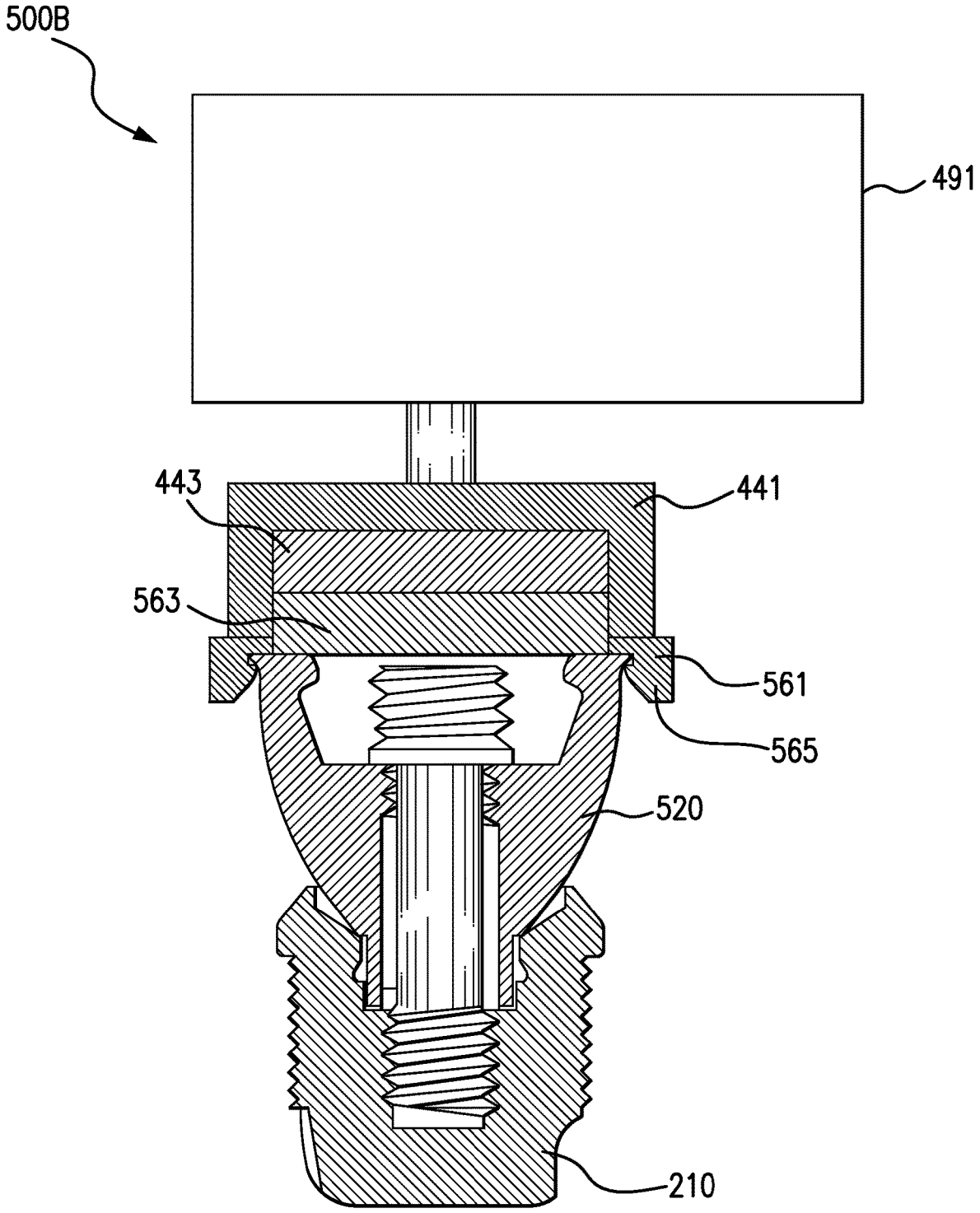
FIG. 5B depicts a side view of another exemplary bone conduction device according to an embodiment.

FIG. 5B depicts an alternate embodiment of an exemplary bone conduction device 500B including fixture 210 and abutment 520 held thereto with abutment screw 230. Bone conduction device 500B includes operationally removable component 491 as detailed above with respect to FIG. 4C.

The bone conduction device 500B further includes an adapter 561 attached to the abutment 520. More specifically, the adapter 561 includes a female portion having sidewalls 565 that interface with the flared portion 529 to snap-couple the adapter 561 to the abutment 520 in a manner analogous to and/or substantially the same as that of the embodiment of FIG. 5A. Accordingly, the adapter 561 permits the operationally removable component 491 to be attached, indirectly, to the abutment 520.

The adapter 561 further includes ferromagnetic mass 563 which functions in a manner analogous to and/or substantially the same as the masses detailed above with respect to connection established via magnetic attraction. It is noted that in the embodiment depicted in FIG. 5B, only one of ferromagnetic mass 443 and ferromagnetic mass 563 are permanent magnets, while in an alternate embodiment, both are permanent magnets having their polarity opposite one another.

Owing to the fact that the adapter 561 includes a male portion (the ferromagnetic mass 563) that extends into the female portion of coupling apparatus 441, positive retention in the lateral direction (i.e., normal to the longitudinal axis of the abutment 220) is provided.

It is noted that the embodiment of FIG. 5B can be configured such that the ferromagnetic mass 563 has a smaller diameter such the resulting adapter can connect the operationally removable component 490 to the abutment 520 (e.g., the ferromagnetic mass 563 fits into coupling apparatus 440 in a manner analogous to and/or substantially the same as element 462 fits therein). If the resulting magnetic attraction between the adapter and coupling apparatus 440 exhibits performance that does not provide for as broad a range of utility as might otherwise be desired, ferromagnetic mass 563 can be extended downward into the female portion of abutment 520 to abutment screw 230 and/or past (around) abutment screw 230. Alternatively or in addition to this, ferromagnetic mass 563 can be extended upward (if it is utilitarian for the coupling apparatus 441 to directly contact the top of sidewalls 565 of the adapter 561, the sidewalls 565 can be extended upwards more as well).

Figure 5C:
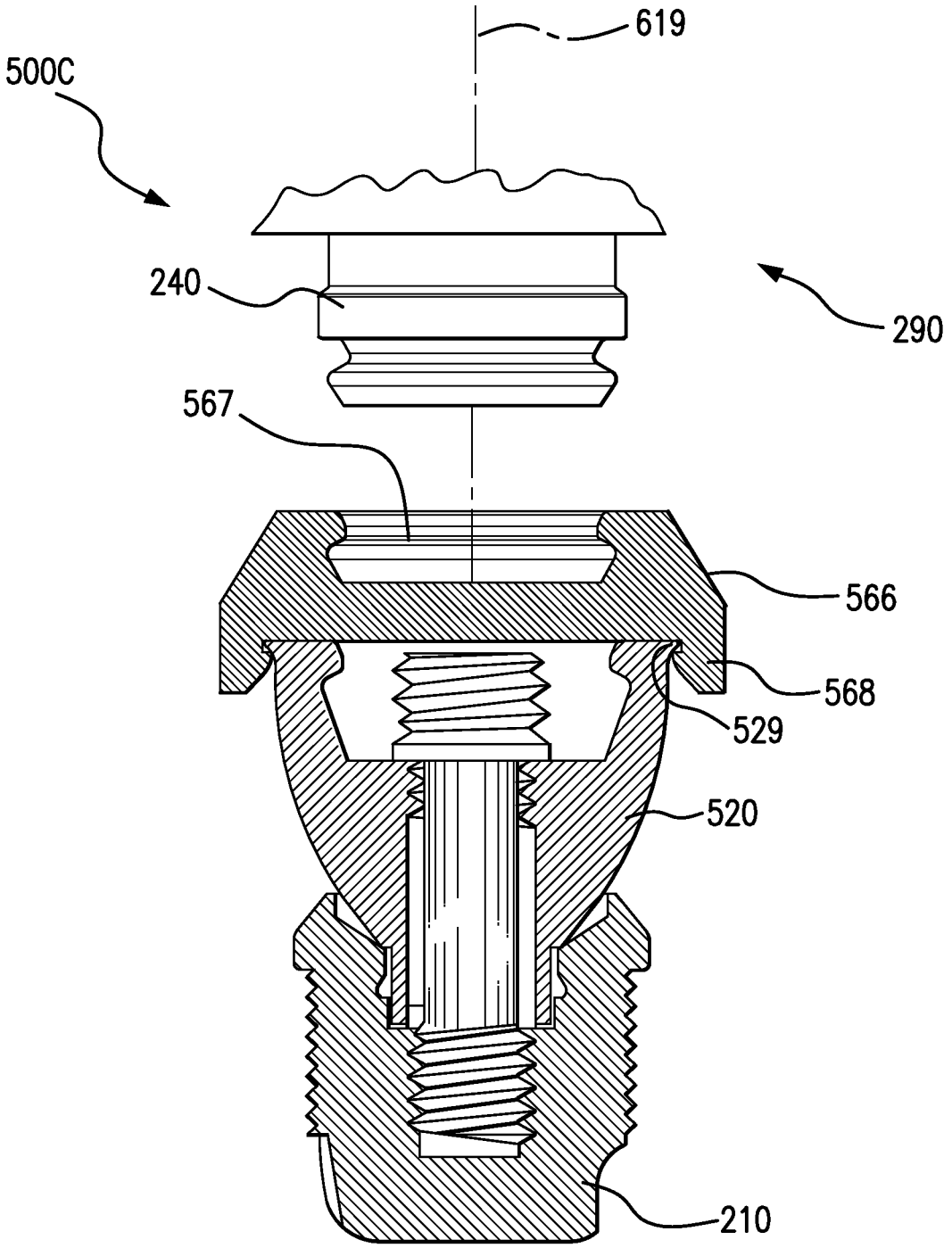
FIG. 5C depicts a side view of another exemplary bone conduction device according to an embodiment.

It is noted that while the embodiments detailed above have been described in terms of an adapter having a male portion that interfaces with a female portion of a coupling apparatus of an operationally removable component, other embodiments include an adapter having a female portion that interfaces with a male portion of a coupling apparatus of an operationally removable component, as may be seen in FIG. 5C. By way of example only and not by way of limitation, a recipient can have a bone conduction implant that has an abutment (or corresponding structure) that is configured to directly connect to operationally removable component 390, operationally removable component 490 and/or operationally removable component 491 and/or the operationally removable component configured to directly attach to abutment 520. Accordingly, the abutment (or corresponding structure) will have the interfacing male portion. Some embodiments include a bone conduction device including an adapter configured to enable a different operationally removable component to be attached to such a given abutment (or corresponding structure) such that it utilizes the teachings detailed herein and/or variations thereof in reverse and/or in any manner to implement these teachings.

In some embodiments, it is utilitarian to connect an operationally removable component that has a coupling apparatus that has a male portion (e.g., such as operationally removable component 290 detailed in FIGS. 2A and 2B) to a recipient. Accordingly, an embodiment includes an adapter that has a female portion configured to receive the male portion of the coupling apparatus of the operationally removable component, and a female portion configured to receive the male portion of the abutment (or corresponding structure) such that it utilizes the teachings detailed herein and/or variations thereof in an applicable manner to implement these teachings.

FIG. 5C depicts an alternate embodiment of an exemplary bone conduction device 500B including fixture 210 and abutment 520 held thereto with abutment screw 230. Bone conduction device 500C includes operationally removable component 290 corresponding to that of FIG. 2A detailed above.

The bone conduction device 500C further includes an adapter 566 attached to the abutment 520. More specifically, the adapter 566 includes a female portion having sidewalls 568 that interface with the flared portion 529 to snap-couple the adapter 566 to the abutment 520 in a manner analogous to and/or substantially the same as that of the embodiment of FIG. 5A.

The adapter 566 further includes a second female portion, female portion 567. The female portion 567 is analogous to and/or substantially the same as female portion of abutment 220 detailed above and is established by sidewalls as is the case with the female portion of abutment 220. In the exemplary embodiment depicted in FIG. 5C, the operationally removable component 290 snap-couples to the adapter 566 upon insertion of coupling apparatus 240 into the female component 467, such as occurs when the operationally removable component is moved in the direction of longitudinal axis 619 of the adapter 566 towards the adapter 566. Accordingly, the adapter 566 permits the operationally removable component 290 to be attached, indirectly, to the abutment 520.

Also, some embodiments include adapters with male-male configurations, female-female configurations, female-neutral configurations (e.g., adapter 560), male-neutral configurations and/or neutral-neutral configurations (e.g., which can be achieved via, for example, a magnetic arrangement between a component of the bone conduction implant (e.g., abutment and/or abutment screw)). Any device, system and/or method of removably coupling one type of operationally removable component to a bone conduction implant that is not bone conduction compatible (e.g., any resulting connection does not result in a connection such that an effective hearing percept and/or a functionally utilitarian hearing percept is evoked) with that operationally removable component and/or visa-versa can be utilized in some embodiments.

It is further noted that while the embodiments detailed above have been described in terms of an adapter configured such that a different type of operationally removable component can be attached to a given bone conduction implant already implanted in a recipient, in some embodiments, it can be utilitarian to provide an adapter that enables a given functional component to attach to a different bone conduction implant than that implanted in the recipient. For example, a method can entail removing a portion of a bone conduction implant (e.g., an abutment) that is compatible with a given operationally removable component and replacing it with one that is not compatible with the given functional removable component. The method can entail utilizing an adapter to connect the given operationally removable component to the new non-compatible component to obtain a bone conduction compatible coupling.

Figure 6A:
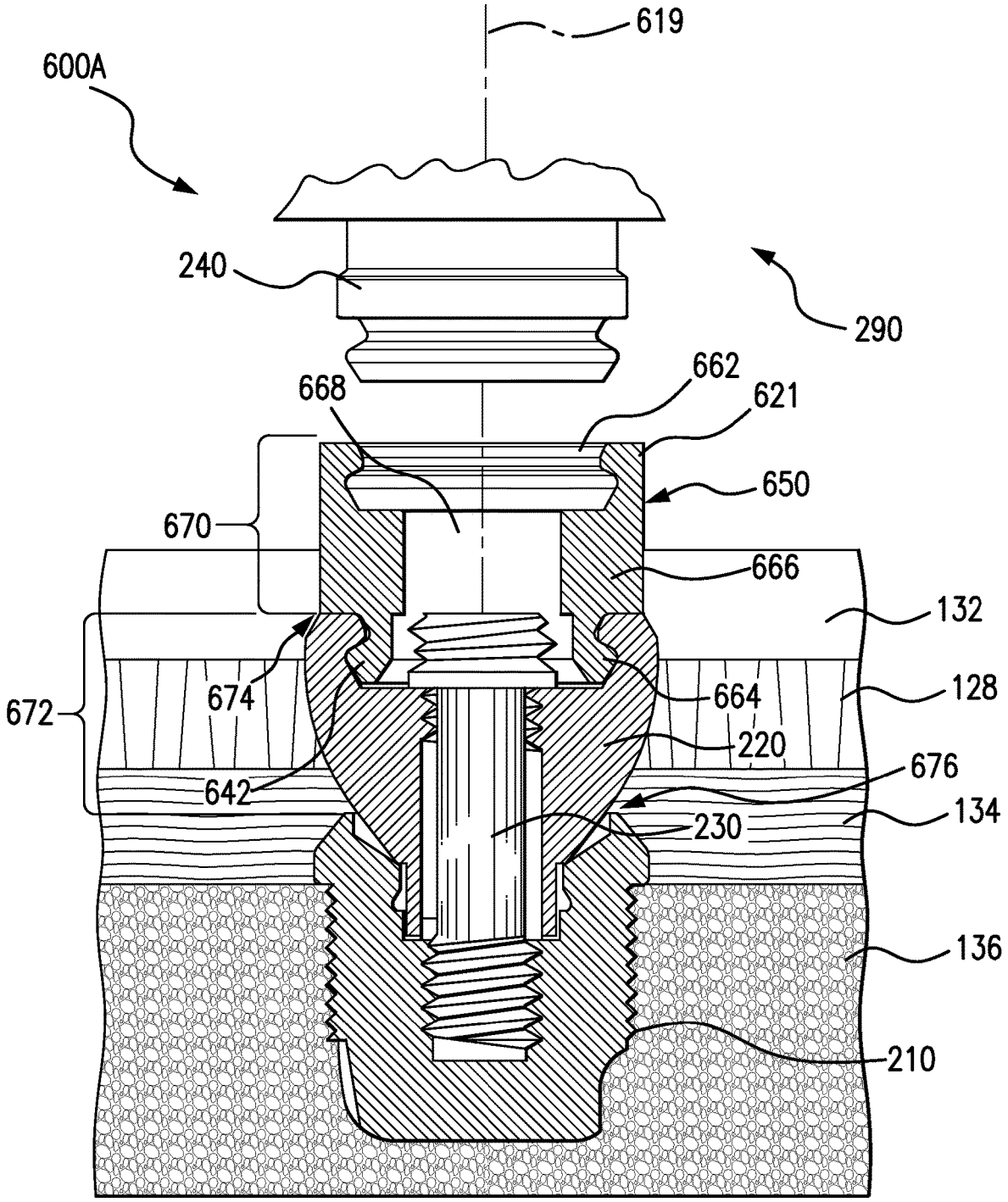
FIG. 6A depicts a side view of another exemplary bone conduction device according to an embodiment.

FIG. 6A depicts an alternate embodiment of a bone conduction device 600A, including an abutment 220 attached to bone fixture 210 via abutment screw 230, with an adapter 650 directly attached to abutment 220. Adapter 650 includes a female portion 662 and a male portion 664. The female portion 662 is analogous to and/or substantially the same as female portion of abutment 220 and is established by sidewall 621 as is the case with the female portion of abutment 220, which is established by sidewall 221. The male portion 664 is analogous to and/or substantially the same as the male portion of coupling apparatus 240, and is established by teeth 642, as the case with the male portion of the coupling apparatus 240, which is established by teeth 242. The female portion 662 and the male portion 664 are connected via an abutment portion 666 which is depicted as a cylindrical section extending between the male and female portions.

It is noted that while the abutment section 666 is depicted as being relatively elongate, other embodiments can have a less elongate section and/or no elongate section at all. While a utility of the elongate section will be detailed below, it is noted that an adapter having the minimal and/or no abutment section 666 can have utility to account for a worn female portion of abutment 230. That is, by sizing the male portion 664 of the adapter 650 in a utilitarian manner (likely such that the outer periphery of the teeth of the male portion 664 has a larger diameter than the teeth of the coupling apparatus 240), a worn abutment can be salvaged. The female portion 662 can have the same dimensions as the original female portion of the abutment, and/or can have different dimensions (e.g., a smaller interior diameter) to account for wear on the coupling apparatus 240. This can have utility in that the abutment 230 need not be removed from the recipient while still addressing wear. An exemplary embodiment includes a method of salvaging such a worn abutment that is integrated to skin of the recipient by attaching such an adapter thereto without removing the abutment. In an exemplary embodiment, the adapter 650 is custom altered (including machining based on the dimensions of the worn abutment, hand filing and hand sanding, etc.) to interface with the worn abutment, which can entail an iterative process (e.g., material from the pertinent portions of the adapter can be removed (e.g., via filing or sanding, etc., in limited amounts, and then the adapter can be fitted to the abutment, and if the fit is not sufficiently utilitarian, more material can be removed from the adapter, and then the adapter can be fitted to the abutment again, and so on, until a utilitarian fit is established).

It is noted that while the adapter 650 is depicted as having an outer periphery that is cylindrical, alternate embodiments have other types of profiles (tapered, hourglass shaped, parabolic, etc.). Any shape of the adapter 650 that will enable the teachings detailed herein and/or variations thereof to be practiced can be utilized in some embodiments.

As may be seen, adapter 650 includes through-hole 668, which enables access to abutment screw 230 for an installation tool as detailed above. It is noted that an alternate embodiment need not have through-hole 668, as is the case with some of the embodiments of adapters detailed above.

The adapter of FIG. 6A and/or other adapters herein and/or variations thereof can have utility by providing an abutment extension in the event of skin overgrowth. In this regard, some scenarios of use are such that at a first temporal location, the abutment 220 is connected to fixture 210 such that the outer surface of the skin (i.e., the side facing away from the inside of the recipient) is below the top portion of the abutment 220 by about 0.5, 1, 1.5, 2, 2.5, 3, 3.5, 4, 4.5, 5, 5.5, 6 mm or more and/or any value or range of values therebetween in 0.1 mm increments). During a temporal period spanning the time from the first temporal location and a second temporal location (e.g., about 0.5, 1, 2, 3, 4, 5, 6, 7, 8 or more years or more or any value or range of values therebetween in one week increments), a operationally removable component 290 is removably attached to the abutment 220 (e.g., such as in the configuration of FIG. 2A) and bone conduction is utilized to effectively evoke a hearing percept, if not a functionally utilitarian hearing percept (where such might be practiced during a second sub-period that begins after a first sub-period after the first temporal location sufficient for utilitarian healing of the bone, etc.). At some point during and/or after that temporal period, the skin grows such that the aforementioned skin-abutment top to skin distance is reduced from the initial distance. Such reduction can be a reduction by less than 100% of the distance, 100% of the distance (i.e., the surface of the skin and the top of the abutment is flush) or more than 100% of the distance (i.e., the skin is above the top surface of the abutment, as depicted in FIG. 6A. With respect to the scenario just detailed where the reduction is equal to 100% or more than 100% (the latter percentage being depicted in FIG. 6A), the likelihood that the coupling 240 can contact the skin is increased relative to if the surface of the skin was below the abutment. Moreover, with respect to this scenario, it can be that the skin begins to enclose the abutment (i.e., encroach from the sides, covering the top of the abutment), thus inhibiting if not preventing utilitarian coupling of the operationally removable component 290 to the abutment 220. Also, even if the skin does not enclose the abutment, such reduction of 100% or more can inhibit if not prevent utilitarian coupling of the operationally removable component in embodiments utilizing coupling apparatuses that have abutment interfacing components with diameters that are greater than the diameter of the abutment (e.g., operationally removable component 390, etc.). Indeed, such can be the case even if the reduction is less than 100% if the coupling apparatus envelops a part of the abutment (e.g., such as is the case with operationally removable component 390) during normal use.

Moreover, even if utilitarian coupling of the operationally removable component is possible with whatever reduction is present, the reduction can result in one or more parts of the operationally removable component contacting skin of the recipient (e.g., the coupling apparatus, the housing enclosing the vibrator of the operationally removable component (which can occur at a spatial distance away from the abutment), etc.). Such can result in feedback (e.g., vibrations generated by the vibrator traveling through the skin and back into the operationally removable component).

In an exemplary embodiment, there is a method, device and/or system of alleviating the aforementioned effects of the aforementioned skin-growth scenarios, as will now be detailed.

More specifically, the embodiment of FIG. 6A can have utility in that it can extend the total distance from the bone to the location at which the coupling apparatus is connected to the bone conduction implant, thus moving that distance upward relative to the surface of the skin. Such will also move the entire operationally removable component away from the surface of the skin by about a corresponding amount. Accordingly, an exemplary embodiment includes a method of using an adapter 650 to achieve this result. Thus, depending on the height of the abutment (the distance of 670—detailed further below), the total distance from the bone to the location at which the coupling apparatus is connected to the bone conduction implant can be changed such that utilitarian coupling can be obtained and/or skin conducted feedback is reduced, including substantially reduced and/or eliminated (such feedback reduction being accomplished by, for example, a method including the action of moving the coupling location a sufficient distance above the skin and/or moving the operationally removable component upward such that no part of the housing or the like contacts the skin during normal use and/or operation. Such can be accomplished, in an exemplary embodiment, without removing the abutment 220 from the recipient and/or without unconnecting the abutment 220 from the fixture 210 and/or without unscrewing and/or loosening the abutment screw 230. Such can have utility in the event that the abutment 220 is integrated as detailed above to skin of the recipient. (When at least about 50% of the surface area of the abutment in direct contact with the skin is integrated with the abutment, it is considered that the abutment is substantially integrated to the skin.) Accordingly, an exemplary method includes moving a location of coupling of a coupling apparatus of an operationally removable component of a bone conduction device to a bone conduction implant from a first location to a second location different from the first location without removing the portions of the bone conduction implant that achieved the coupling at the first location. Such method further includes, in an exemplary embodiment, doing so while skin is integrated (including substantially integrated) to at least a portion of the bone conduction implant without effectively disturbing that integration level as a result of execution of the method (e.g., about 70%, 80%, 90% and/or 100% and/or any percentage thereof or range of percentages thereof between any of these values in about 1% increments of integration is maintained after the method). In an alternate embodiment, such method further includes doing so while skin is integrated (including substantially integrated) to at least a portion of the bone conduction implant without substantially disturbing that integration level (e.g., about 90%, 95%, and/or 100% and/or any percentage thereof or range of percentages thereof between any of these values in about 1% increments of integration is maintained after the method).

In an exemplary embodiment, the abutment 220 and the adapter 650 are configured to connect to one another such that the percutaneous portion of the bone conduction device corresponding to the abutment 220 and the adapter 650 are effectively monolithic. In an exemplary embodiment, the abutment 220 and the adapter 650 are configured to connect to one another such that the adapter 650 extends the effective length of the percutaneous portion of the bone conduction device (i.e., the distance measured parallel to the longitudinal axis of the abutment and on a plane lying on and parallel to the longitudinal axis of the abutment from the outer surface of bone 136 to the outer surface of skin 132) by at least about 10, 15, 20, 25, 30, 35, 40, 45, 50, 55, 60, 65, 70, 75 and/or 80 percent and/or any value or range of values between any of these values in about 1% increments (e.g., 17%, 36% to 59%, etc.).)

It is noted that while the adapter 650 is depicted has having a female portion 662 that is analogous to and/or substantially the same as the female portion of the abutment 220, in an alternate embodiment, the adapter 650 can have any of the portions detailed herein and/or variations thereof (e.g., the male portion 362 of FIG. 3E instead of the female portion 662, the male portion 462 of FIG. 4B instead of the female portion 662, the neutral portions described above and/or any variations thereof, etc.) It is further noted that while the adapter 650 is depicted as having a male portion 664 that is analogous to and/or substantially the same as the female portion of the abutment 220, the adapter 650 can have any of the portions detailed herein and/or variations thereof (e.g., the female portions described above with respect to the alternate embodiments configured to connect operationally removable component 290 to an abutment or other corresponding structure configured to interface with the coupling apparatuses of operationally removable component 390, 490, 491, 590, the neutral portions described above, and/or any variations thereof, etc.)

Also, while snap couplings are depicted as being utilized to connect the adapter 650 to the abutment 220, other devices, systems and/or methods can be utilized to connect the adapter 650 to the abutment, such as by way of example and not by limitation, the use of a system analogous to how adapter 350 is attached to abutment 220 via the external threads of abutment screw head 270. Any device, system and/or method of connecting the adapter 650 to the bone conduction implant can be used in some embodiments.

Moreover, in an exemplary embodiment, any of the adapters detailed herein and/or variations thereof can be attached to the adapter 650 (e.g., resulting in an adapter directly connected to an adapter).

The configuration and use of the embodiment of FIG. 6A is such that the abutment 220 is a primary abutment, and the adapter 650 is a secondary abutment. In the exemplary embodiment of FIG. 6A, the abutment 220 includes a first outer periphery 670 extending about the longitudinal axis 219 (not shown). The adapter 650 includes a second outer periphery 672 extending about an axis that is parallel to the longitudinal axis 219 (not shown). This axis can be the same as longitudinal axis 619 as depicted in FIG. 6A, or can be different (e.g., the longitudinal axis of the adapter 650). As may be seen in FIG. 6A, the outer peripheries are substantially aligned at a transition location 674 between the abutment 220 and the adapter 650. In the exemplary embodiment, tangent planes of the surfaces of the two outer peripheries are parallel to one another and contact one another at the transition location 674, although in an alternate embodiment, such as that depicted in FIG. 6A, is not the case. Also, in the exemplary embodiment of FIG. 6A, the connection between the abutment 220 and the adapter 650 is such that the transition between the two along the outer peripheries thereof is at least substantially seamless, while in an alternate embodiment, such is not the case.

Still with reference to FIG. 6A, some features pertaining to the height of the adapter 650, by itself and also relative to the abutment 220, will now be described. In this regard, the abutment 220 includes a connection height measured parallel to the longitudinal axis of the abutment 220 and on a plane lying parallel to and on a longitudinal axis of the abutment (i.e., on the plane of FIG. 6A), wherein the connected height is measured from an outer interface 676 of the abutment 220 and bone fixture 210 to the transition location 674. In the embodiment of FIG. 6A, this height is the height spanning the distance of the second outer periphery 672. In an exemplary embodiment, the height is about 6, 9 or 12 mm and/or any value or range of values between any of these values in about 0.05 mm increments (e.g., 9.25 mm, 8.6 mm to 11.8 mm, etc.) Further, the adapter 650 includes a connected height measured parallel to and on a plane (i.e., on the plane of FIG. 6A) lying on and parallel to a longitudinal axis 619 of the adapter 650, wherein the connected height of the adapter is measured from an outer interface of the abutment and the coupling apparatus (i.e., transition location 674) when the abutment 220 and the adapter are connected, to the top of the adapter 650. In the embodiment of FIG. 6A, this height is the height spanning the distance of the first outer periphery 670. Further, the connected height of the adapter 650 is at least about 0.15, 0.2, 0.25, 0.3, 0.35, 0.4, 0.45, 0.5, 0.6, 0.7, 0.8, 0.9, 1.0, 1.1, 1.25, 1.5, 1.75 and/or 2 and/or more times that of the connected height of the abutment 220 and/or any value or range of values between any of these values in about 0.05 increments (e.g., 0.55, 0.35 to 0.75, etc.). In an exemplary embodiment, the height is about 2, 3, 4, 5, 6, 7, 8, 9, 10, 11, or 12 mm and/or any value or range of values between any of these values in about 0.05 mm increments (e.g., 3.35 mm, 2.6 mm to 10.8 mm, etc.)

In an exemplary embodiment the adapter 650 includes a deformable portion configured to deform when in substantial compressive contact with the abutment 220 (e.g., such as that resulting from the snap-coupling of the adapter 650 to the abutment 220, etc.), thereby establishing a microbial-tight seal/anti-microbial seal at the deformable portion. In an exemplary embodiment, this prevents and/or effectively reduces the ability of bacteria or other microbes from entering from an outside of bone conduction implant to an inside thereof through the interface between the adapter 650 and the abutment 220. In an exemplary embodiment, such deformable portions can be located at least some of the locations that abut each other (e.g., at the top of the abutment 220 and/or the bottom of the adapter 650 at and/or inboard of the outer periphery of the two elements at the transition location 674) such can be accomplished via the teachings of U.S. Patent Application Publication No. 20120172658, entitled "Medical Implant System," by applicants Goran Björn and Dr. Marcus Andersson.

Also, an exemplary embodiment includes an abutment having a coating on various surfaces of the abutment 220 and/or the adapter 650 at least at some of the locations that abut each other (e.g., at the top of the abutment 220 and/or the bottom of the adapter 650 at and/or inboard of the outer periphery of the two elements at the transition location 674) of an anti-microbial agent in accordance with the teachings of U.S. Patent Application Publication No. 20100286776 entitled Percutaneous Bone Conduction Implant by applicant Dr. Marcus Andersson.

Figure 6B:
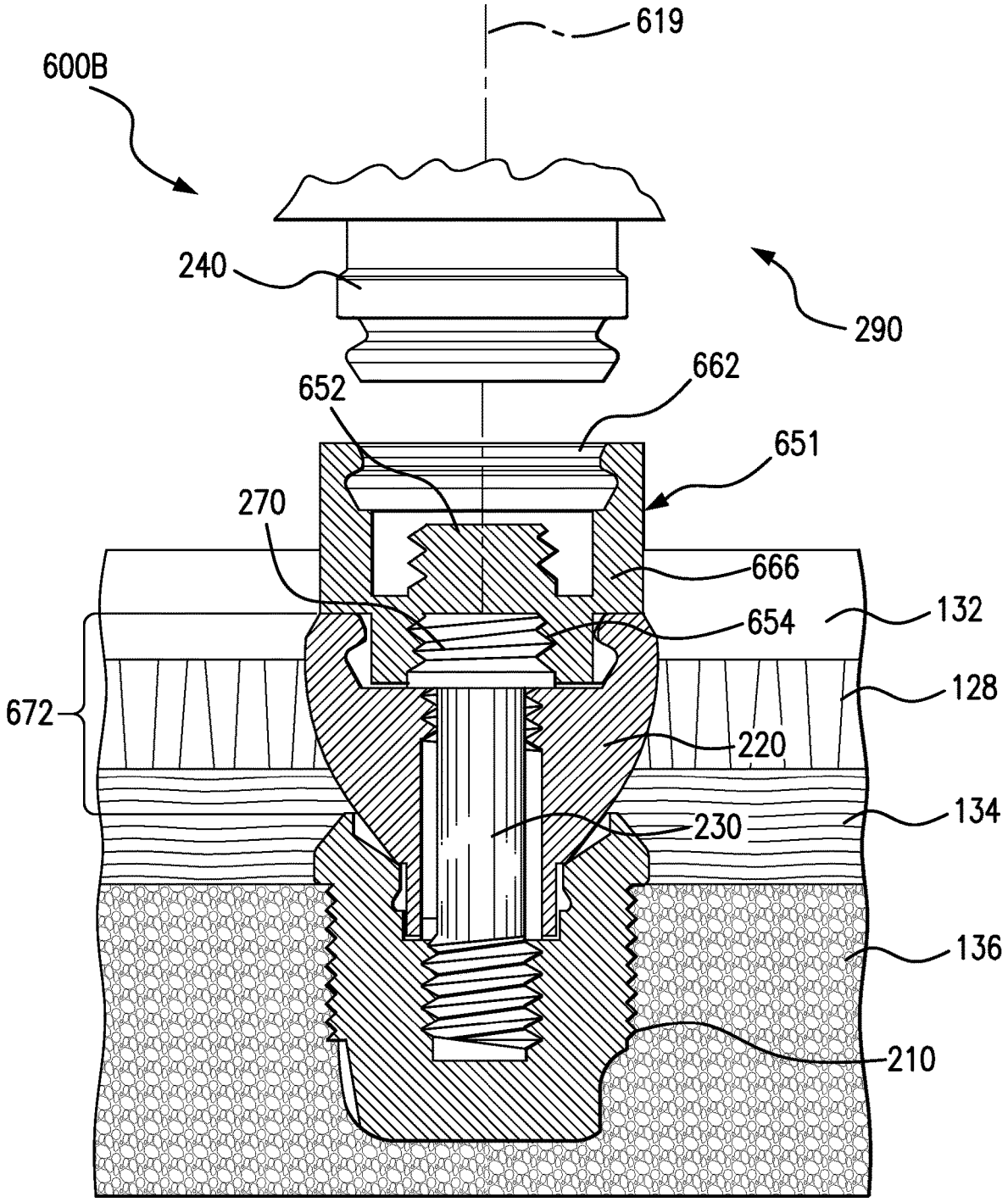
FIG. 6B depicts a side view of another exemplary bone conduction device according to an embodiment.

FIG. 6B depicts an alternate embodiment of a bone conduction device 600B generally corresponding to that of FIG. 6A, except that the adapter 651 does not include a through bore, but instead includes a male threaded boss 652 and includes a bore 654 including female threads. Bore 654 includes female threads that interface with the male threads of the abutment screw head 270, thereby fixedly connecting the adapter 350 thereto in a manner analogous and/or the same as that detailed above with respect to adapter 350 of FIG. 3A.

The female portion 662 is analogous to and/or substantially the same as female portion of the adapter of FIG. 6A.

In the embodiment of FIG. 6B, the threaded boss 652 is configured to be substantially similar and/or identical to at least the outer portions of the abutment screw head 270, if not the entire head (i.e., it may or may not include the internal upper bore 272 that may form a unigrip, internal hex or multi-lobular configuration for a cooperating insertion tool, etc.), or at least the outer configuration is functionally similar and/or functionally the same as the abutment screw head 270. Along these lines, in an exemplary embodiment, the threaded boss 652 is configured such that it is used to for performing implant stability quotient (ISQ) testing on the implant/the fixture 210 in a manner analogous to and/or the same as is performed using the abutment screw head 270. More particularly, abutment screw head 270 is, at least in some embodiments, configured for ISQ testing of the implant/fixture (the male threads provide for utilitarian coupling of the device used for ISQ testing, although some embodiments can be practiced with other types of coupling in the absence of male threads).

Further along these lines, some embodiments of the adapter s detailed herein, such as for, example the adapter 650 of FIG. 6A, are such that at least some current devices for ISQ testing might not be configured to fit all the way through bore 668 to utilitarianly interface with the abutment screw 230. The adapter 651 of FIG. 6B is configured such that a wider range of such devices can be used for ISQ testing without removing the adapter 651 (which might be integrated to the skin or otherwise might provide utilitarian features by not removing the adapter 651, as replacement thereof might pinch the skin or otherwise necessitate moving the skin outward, which might be uncomfortable for the recipient, etc.).

Figure 6C:
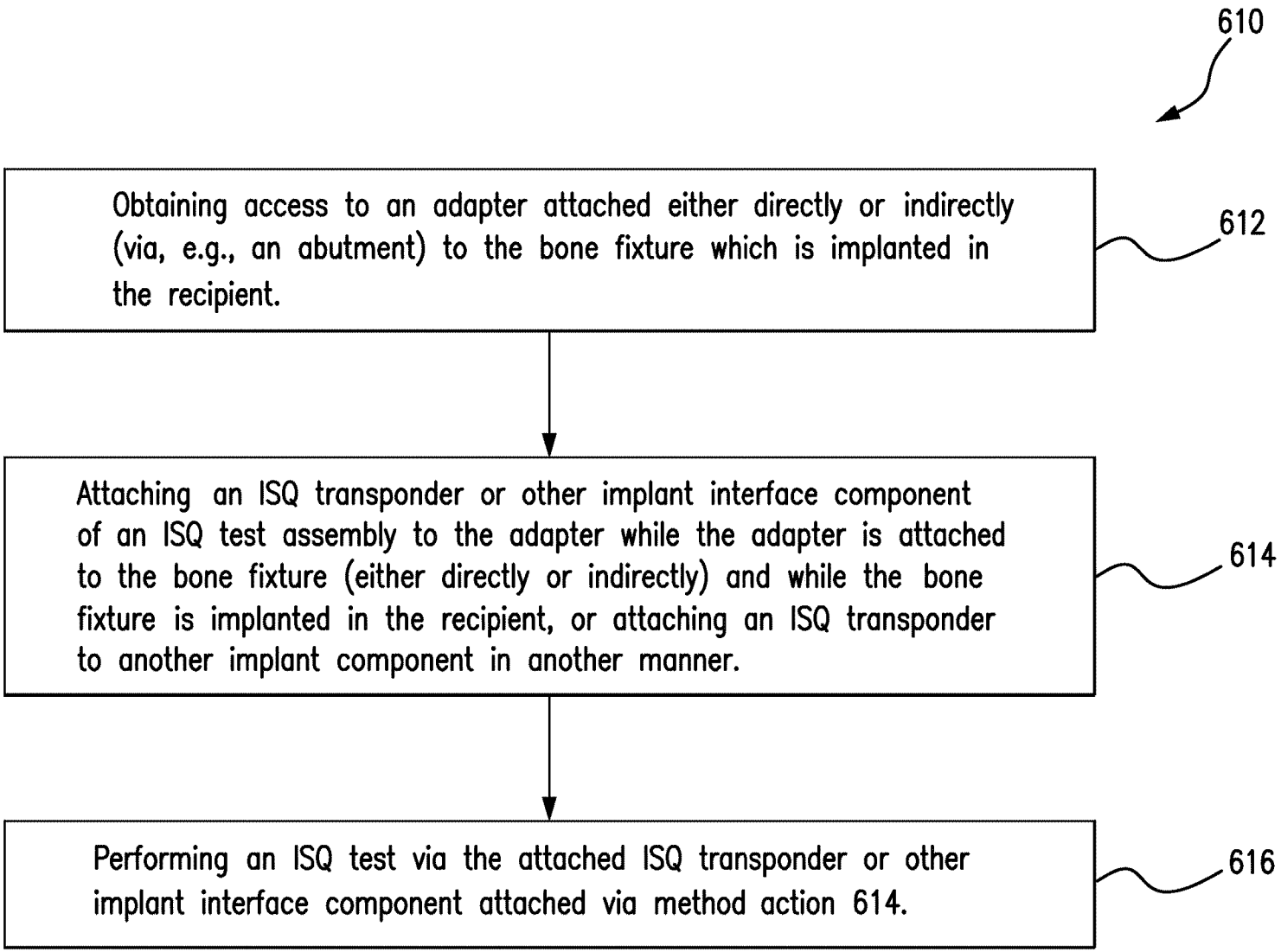
FIG. 6C depicts a flow chart representing an exemplary method according to an exemplary embodiment.

In this regard, there is an exemplary method of performing an ISQ test. Referring to FIG. 6C, there is a method 610 performing an ISQ test on an implanted bone fixture, such as the bone fixture of FIG. 6B. The method includes action 612, which entails obtaining access to an adapter attached either directly or indirectly (via an abutment) to the bone fixture which is implanted in the recipient. The method further includes action 614, which entails attaching an ISQ transponder or other implant interface component of an ISQ test assembly to the adapter while the adapter is attached to the bone fixture (either directly or indirectly) and while the bone fixture is implanted in the recipient. In some embodiments, this method is executed while the bone fixture and/or the abutment is integrated, including substantially integrated, to skin of the recipient. In an exemplary embodiment, the ISQ transponder or other implant interface component of the ISQ test assembly is configured to interface with a threaded boss of the adapter (e.g., a threaded boss 652 as depicted in FIG. 6B). In an alternate embodiment, it is attached to another component of the adapter (e.g., the female portion 662, etc.) In an alternate variation of this method action, the transponder or interface component is instead fit through a bore of the adapter to interface with a component other than the adapter (e.g., the abutment screw) that is either directly or indirectly attached to the bone fixture. In an alternate variation of this method action, the transponder or other interface component is configured to interface with the bone fixture.

After method action 614, the method includes action 616, which entails performing an ISQ test via the attached ISQ transponder or other implant interface component attached via the method action 614.

It is noted that in an exemplary embodiment, the boss 652 is relatively more elongate than that depicted in FIG. 6B. For example, the boss 652 can extend to the top of the adapter 651, thus providing a similar and/or the same pertinent geometry as the abutment screw head 270 of, for example, FIG. 3A. Any device, system or method that can enable the teachings detailed herein and/or variations thereof regarding ISQ testing can be utilized in some embodiments. Conversely, an alternate embodiment includes the use of an ISQ test adapter that is configured to reach down to the boss 652 and connect thereto such that the transducer or other interface component can connect to the ISQ test adapter.

Figure 7A:
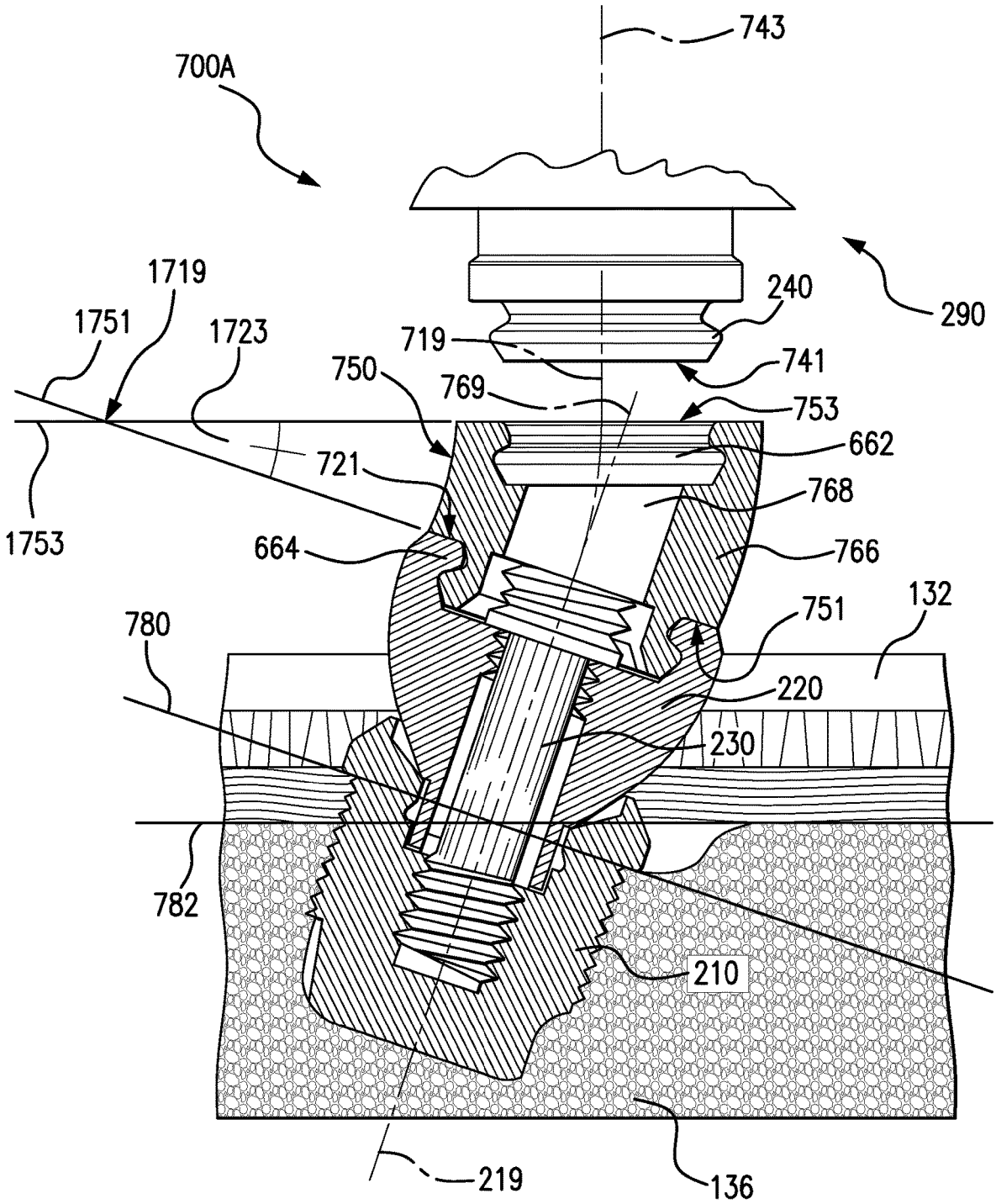
FIG. 7A depicts a side view of another exemplary bone conduction device according to an embodiment.

FIG. 7A depicts an alternate embodiment of a bone conduction device 700A, including an abutment 220 attached to bone fixture 210 via abutment screw 230, with an adapter 750 directly attached to abutment 220. As with adapter 650, adapter 750 includes a female portion 662 and a male portion 664, the properties of these elements being analogous to and/or substantially the same as those detailed above. The female portion 662 and the male portion 664 are connected via a portion 766 which is depicted as a segment of a ring torus bounded by two planes that pass through one another at the axis about which the ring torus extends (detailed further below). Other geometric configurations can be utilized (e.g., an arcuate conical shape that expands with increasing or decreasing distance from the abutment 220, an hour glass shape, etc.) It is noted that while the adapter 750 is depicted as having an outer periphery that is circular, alternate embodiments have other types of profiles (tapered, hourglass shaped, parabolic, etc.). Any shape/configuration that will enable the teachings detailed herein and/or variations thereof to be practiced can be utilized in some embodiments of adapter 750 and/or variations thereof.

It is noted that while portion 766 is depicted as being relatively minimally-elongate (e.g., the arcuate distance of the adapter is minimal—essentially just enough to provide a level female portion 662 relative to the local bone, as will be detailed below) other embodiments can have a more elongate section or less/non elongate section (e.g., while the female portion 662 is not level with respect to the skin surface, it is "more level" with respect to the skin surface than the female portion of the abutment 220). In some embodiments, the distance can be essentially just enough to provide an effective angular change of the female portion 662 relative to the female portion of the abutment 220 with sufficient room for the female portion 662 while providing enough material for structural rigidity. In some embodiments, while the female portion of the abutment 220 is level with the surface of the skin, it is the female portion 662 that is not level with the surface of the skin.

As may be seen, adapter 750 includes through-hole 768, which enables access to abutment screw 230 as detailed above. It is noted that an alternate embodiment need not have through-hole 768, as is the case with some of the embodiments of adapters detailed above. It is further noted that while this through-hole 768 is depicted as having a longitudinal axis 769 that is aligned with longitudinal axis 219 of the abutment 230 when the adapter 750 is positioned in its functionally final orientation with respect to the abutment, other embodiments can include an adapter 750 that has a through hole that is offset. Other embodiments can alternatively or in addition to this have a through-hole that has a non-circular cross-section on a plane normal to the axis 769 (e.g., elliptical) and/or non-symmetric cross-section on a plane normal to axis 769 (e.g., egg shaped, the wider portion providing clearance for the installation/removal tool, as utilitarianly viable). Alternatively or in addition to this, a portion of the sidewalls of the female portion of adapter 750 can be removed (e.g., such as the portion on the right side in FIG. 7A) to provide clearance for the installation/removal tool).

Still with reference to FIG. 7A, the adapter 750 includes a first face 751 configured to interface with an end of the abutment 220 (a first face 721 thereof), and the adapter 750 includes a second face 753 at an opposite end of the adapter 750 from that having the first face 751 that is parallel to a face 741 of the coupling apparatus 140. As may be seen, the first face is substantially non-parallel to the second face. In this regard, the faces 751 and 753 lie on respective planes 1751 and 1753 that pass through one another at axis 1719, as may be seen in FIG. 7A. In this regard, it is these planes and axis that correspond to those detailed above with respect to the described portion of the ring torus bounded by two planes (1751 and 1753) that pass through one another at the axis 1719 about which the ring torus extends.

In an exemplary embodiment, the angle 1723 between these two planes 1751 and 1753 is about 5, 6, 7, 8, 9, 10, 11, 12, 13, 14, 15, 16, 17, 18, 19, 20, 22.5, 25, 30, 35, 40, 45, 50 or 55 degrees and/or more and/or any value or range of values between any of these values in 0.1 degree increments.

Also, the adapter 750 includes a longitudinal axis 719 that is substantially arcuate from a first end to a second end of the adapter 750. While the depicted arcuate configuration of axis 719 corresponds to the track taken by a portion of a circle (e.g., non-varying radius about axis 1719), in an alternate embodiment, axis 719 is a compound curve (e.g., elliptical, hyperbolic, varying radius of curvature, etc.). Any adapter having any configuration having any longitudinal axis can be utilized in some embodiments, providing that such embodiments enable the teachings detailed herein and/or variations thereof. The final trajectory of axis 719 is such that it aligns with axis 743 of coupling adapter 240, as may be seen.

As may be seen in FIG. 7A, the abutment 220 extends away from the adapter 750 along a trajectory that is parallel to an abutment face-adapter face interface (i.e., the faces 721 and 751). This trajectory is parallel to axis 219 of the abutment 220. The adapter 750 extends away from the abutment 220 in a trajectory that arcs away from that of the abutment 220. This trajectory is parallel to the axis 719 of the adapter 750. The directions of extensions of the abutment and the adapter can also be described with reference to surfaces of the bone and skin. In this regard, the abutment 220 extends away from bone 136 of the recipient at least partially within skin of the recipient along a trajectory that is substantially normal to a tangent plane 780 relative to at least an extrapolated surface of the bone at about a centerline (e.g., axis 219) of the bone fixture 210 fixing the abutment 220 to the bone 136. The adapter 750 extends away from the abutment 220 in a trajectory that arcs away from that of the abutment 220.

Also, as may be seen in FIG. 7A, the abutment 220 extends away from bone 136 of the recipient at least partially within skin of the recipient along a trajectory that is substantially non-normal to a tangent plane 782 relative to at least a surface of the bone surrounding a fixation device fixing the abutment to the bone at a distance starting at least about 1, 2, 3, 4, 5, 6, or 7 mm and/or any value or range of values between any of these values, from an outer periphery of the bone fixture 210, and the adapter 750 extends away from the abutment 220 in a trajectory that arcs away from that of the abutment 220. (It is noted, however, that in an alternate embodiment, the abutment extends along a trajectory that is substantially normal to the aforementioned reference (plane 782), as will be detailed below.) The aforementioned distances are distances that, in at least some embodiments, are sufficiently far away from the bone fixture (or abutment if the abutment is directly attached to the bone) that alterations to the bone's natural surface due to, for example, the surgical procedure of implanting the bone fixture 210 and/or the abutment 220) are effectively attenuated, and thus a "read," based on general standards, of the bone surface features can be obtained. It is noted that the term "fixation device" as used herein can include the bone fixture 210 and an abutment having a localized feature enabling fixation of the abutment to bone (e.g., threads directly on the abutment (e.g., a monolithic bone fixture-abutment device), etc.).

Further with respect to FIG. 7A, as may be seen, the adapter 750 includes a first face 751 that is substantially non-parallel to the tangent plane 782 relative to at least the surface of the bone surrounding the fixation device (bone fixture, etc.) fixing the abutment to the bone at a distance starting at least about 1, 2, 3, 4, 5, 6, or 7 mm and/or any value or range of values between any of these values, from an outer periphery of the bone fixture 210, and the adapter 750 extends away from the abutment 220 in a trajectory that arcs away from that of the abutment 220. (It is noted, however, that in an alternate embodiment, the first face 751 is substantially parallel to the aforementioned reference, as will be detailed below.) The adapter 750 further includes a second face 753 that is effectively parallel to the tangent plane 782. Further, in the embodiment depicted in FIG. 7A, the second face 753 is substantially parallel to a tangent plane relative to at least an extrapolated surface of skin covering the bone at about a centerline (e.g., axis 719) of a portion of the bone conduction device at the tangent plane of the skin. However, in an alternate embodiment, the aforementioned second face can be parallel and/or non-parallel, respectively, to the respective reference planes. In this vein, in some embodiments, the adapter 750 is configured to adjust the angle between the aforementioned reference tangent planes and the various faces to effectively non-parallel positions. For example, there can be utilitarian value in angling the operationally removable component 290 from an angle that affords parallelisms (such might exist when the abutment extends along a trajectory that is normal to a tangent plane tangent to the surface of bone surrounding the fixture/abutment at any of the aforementioned distances). Such utilitarian value can correspond to lifting a housing portion of the operationally removable component off of skin of the recipient (or more accurately stated, angling the housing portion away from the skin of the recipient), thereby reducing feedback that can exist resulting from vibrations being transferred through the skin into the housing and hence back into the coupling apparatus 240. Put another way, an adapter can be intentionally utilized such that the face 753 is not parallel with the surface of the skin. In this regard, adapters configured as above can be used in such scenarios, and there are thus methods of use of such adapters.

It is noted that while the adapter 750 is depicted has having a female portion 662 and male portion 664, as with adapter 650, different configurations can be utilized depending on the desired utility, as detailed above. Also, as with the adapter 650, in an exemplary embodiment, any of the adapters detailed herein and/or variations thereof can be attached to the adapter 650 (e.g., resulting in an adapter directly connected to an adapter).

Figure 7B:
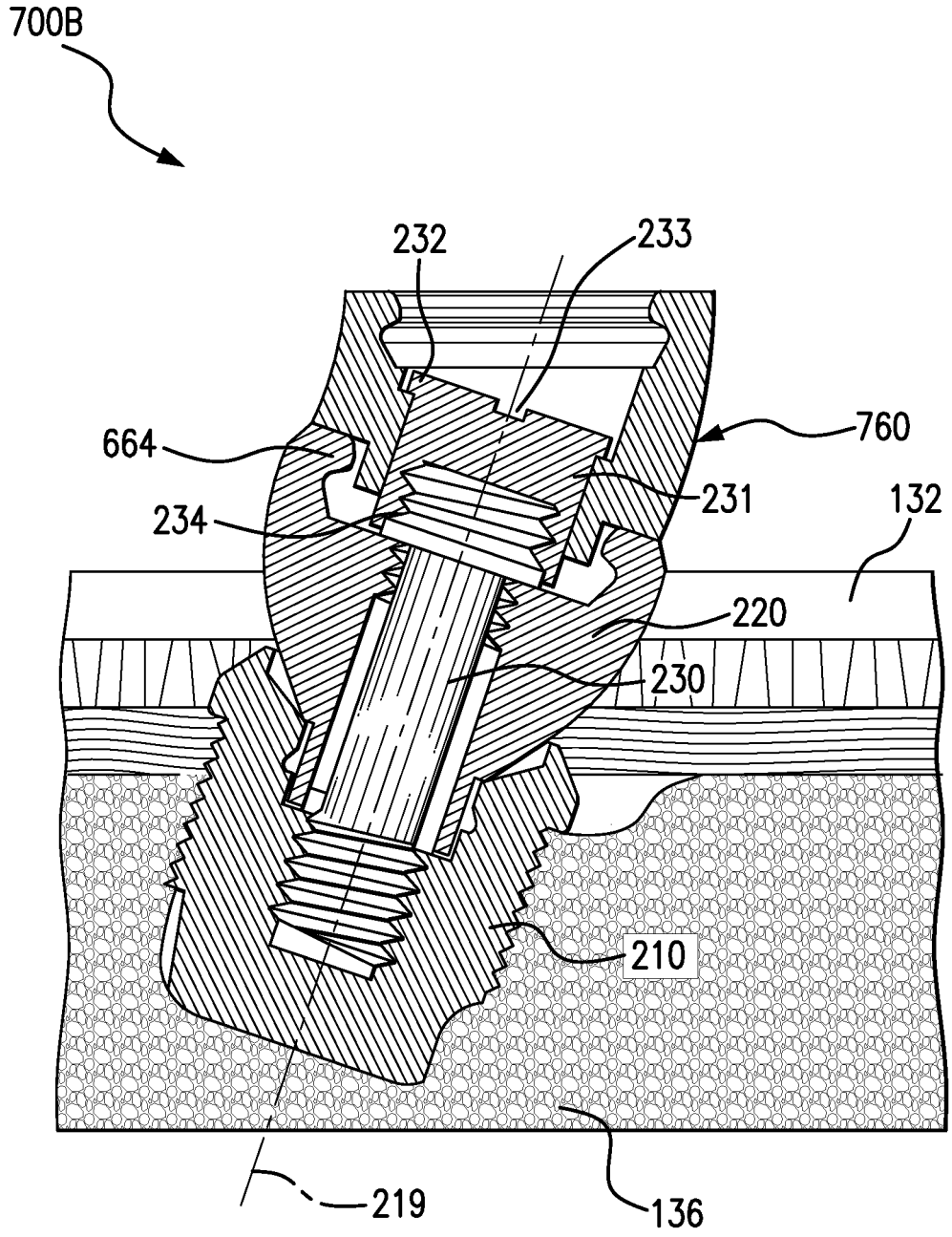
FIG. 7B depicts a side view of another exemplary bone conduction device according to an embodiment.

FIG. 7B depicts an alternate embodiment of a bone conduction device 700B, which generally corresponds to that of FIG. 7A (operationally removable component 290 is not depicted for clarity). However, instead of an adapter 750, there is an adapter 760 that is configured to receive a bolt 231 having female screw threads 234 that interact with the male screw threads of the bolt head of the abutment screw 230, as may be seen. Owing to the male portion 232 that extends outward from the sides of the bolt 231, as the bolt 231 is tightened (via, for example, the application of a torque via a screw driver or the like to screw driver receptacle 233, etc.), the bolt 231 pulls the adapter 760 towards the abutment 220, and ultimately locks the two together via a friction fit between the contact surfaces thereof. In an exemplary embodiment, the bolt 231 places a compressive force onto the adapter 760 which results in sufficient friction between the adapter 760 and the abutment 220 such that adapter 760 resists rotation about the longitudinal axis 219. This can have utility by maintaining the orientation of the adapter 760, and thus the orientation of the connected operationally removable component 290. In this regard, the maintenance of the orientation is such that the orientation is maintained while the operationally removable component 290 is subjected to normal loadings expected for normal use thereof (e.g., loads induced due to jumping, loads induced due to sneezing, loads induced due to walking down and/or up stairs, loads induced due to sitting down or standing up from a seated position, etc.) Conversely, some embodiments do not maintain the orientation when the operationally removable component 290 is subjected to abnormal loads (e.g., such as those resulting from a car accident sufficient to deploy a driver side mounted airbag pursuant to U.S. Department of Transportation standards, jumping from a roof of a one story house, etc.).

It is noted that adapter 760 does not utilize a snap-coupling or the like to couple to the adapter. However, in an alternate embodiment, it can so use such a coupling or the like. It is further noted that the embodiment of FIG. 7A can be configured such that the snap-coupling established between the abutment and the adapter is such that the aforementioned rotation is prevented.

It is noted that the concept of FIG. 7B vis-à-vis the use of the bolt 231 can be utilized with embodiments of the other adapters detailed herein and/or variations thereof.

Some additional exemplary methods according to some exemplary embodiments will now be discussed.

Figure 8:
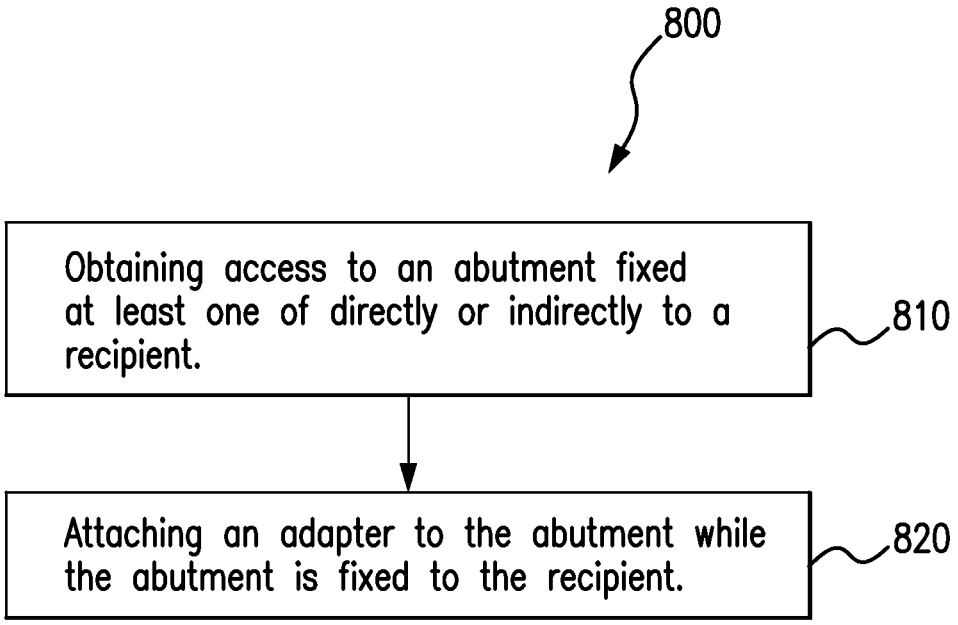
FIG. 8 depicts a flow chart representing an exemplary method according to an exemplary embodiment.

Referring to FIG. 8, there is a method 800 of converting a coupling mechanism of a prosthesis, such as the bone conduction implant 201 of FIG. 2A. The method includes action 810, which entails obtaining access to the abutment 220 (or other abutment, e.g., abutment 520 and/or other abutments) while the abutment is fixed at least one of directly or indirectly to a recipient. The method further includes action 820, which entails, attaching an adapter (such as by way of example, any of adapters 350, 360, 450, 460, 461, 560, 561, 660, 651, 750 and/or 760 and/or variations thereof and/or any other adapter configured to enable the teachings detailed herein and/or variations thereof to be practice) to the abutment 220 while the abutment is fixed to the recipient. In some embodiments, this method is executed while the abutment is integrated to skin of the recipient.

Figure 9:
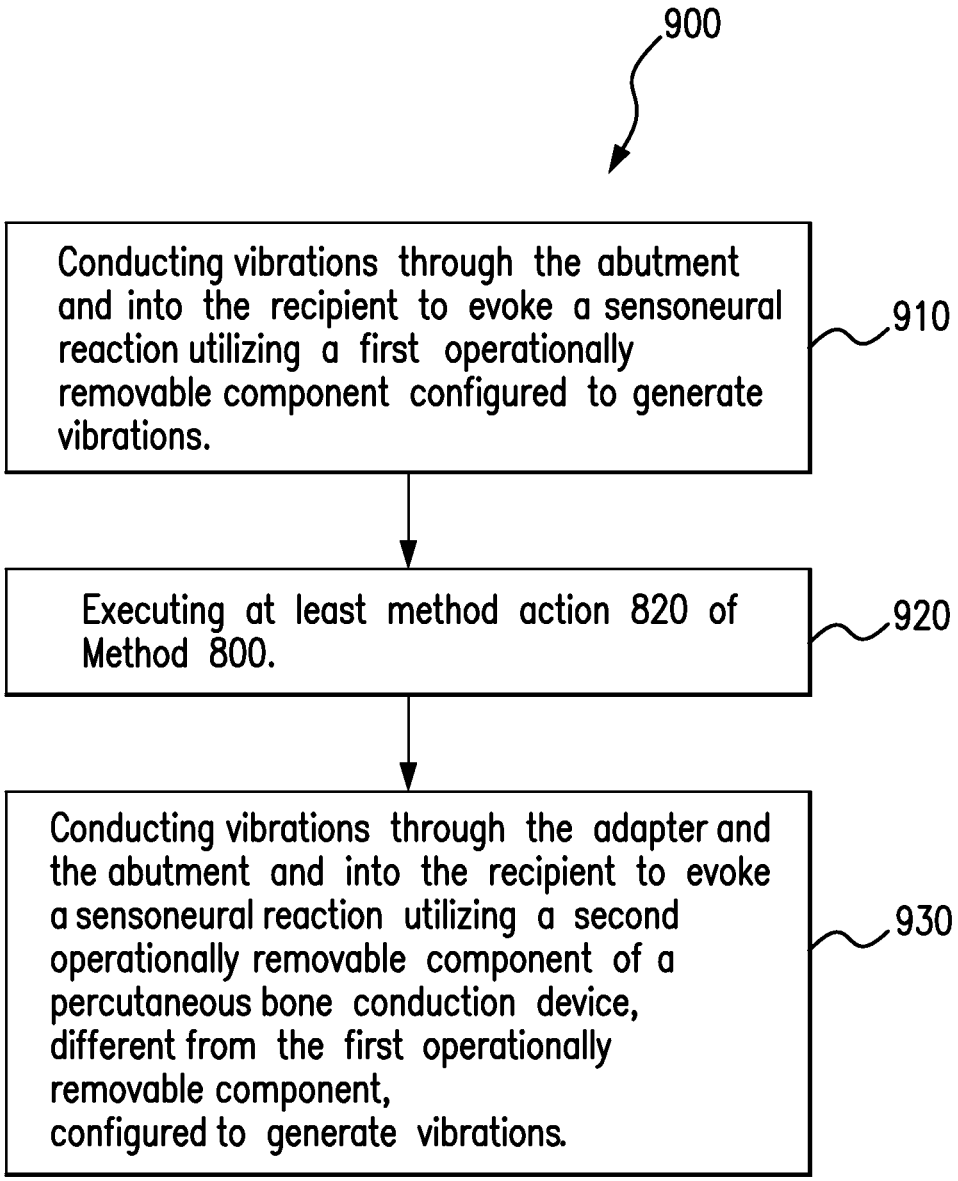
FIG. 9 depicts a flow chart representing another exemplary method according to an exemplary embodiment.

Referring to FIG. 9, there is a method 900 that further expands method 800. Method 900 includes method action 910, which entails conducting vibrations through the abutment and into the recipient to evoke a sensoneural reaction utilizing a first operationally removable component configured to generate vibrations prior to the action of attaching the adapter. (An exemplary sensoneural reaction is a hearing percept. It is noted at this time that some embodiments of the embodiments detailed herein and/or variations thereof are not limited evoking a hearing percept, and the teachings associated herein with respect to a hearing percept include the genus of evoking a sensoneural reaction, and visa-versa.) After completing method action 910, method 900 proceeds to method action 920, which entails executing at least method action 820 of method 800. After executing method action 920, the method proceeds to method action 930, which entails conducting vibrations through the adapter and the abutment and into the recipient to evoke a sensoneural reaction utilizing a second operationally removable component of a percutaneous bone conduction device different from the first operationally removable component, configured to generate vibrations.

It is noted that in an exemplary embodiment, method action 910, which is performed before method action 920, includes the action of conducting the vibrations from the first operationally removable component directly to the abutment. Further, action 930 can include, in an exemplary embodiment, the action of conducting the vibrations from the second operationally removable component directly to the adapter. The methods 800 and 900 are, in an exemplary embodiment, executed while the outer periphery of the abutment is surround by skin of the recipient, as is depicted in, for example, FIGS. 2A, 6 and/or 7, and/or while that skin is integrated to the abutment.

An exemplary embodiment includes executing action 910 periodically over a temporal period spanning at least about 1 week, 2 weeks, 3 weeks, 4 weeks, 5 weeks, 6 weeks, 7 weeks, 8 weeks, 2.5 months, 3 months, 4 months, 5 months 6 months, 7 months, 8 months, 9 months, 10 months, 11 months, 12 months, 1.5 years, 2 years, 3 years, 4 years, and/or 5 years and/or any value or range of values between any of the aforementioned values in 1 day increments. In this vein, in an exemplary embodiment, the first operationally removable component is utilized for example about every day to evoke a hearing percept by conducting vibrations directly therefrom to the abutment over a period of at least 6 months. The recipient removes the operationally removable component from the abutment every night prior to going asleep, and replaces it every morning, at least on days when used. After doing this for at least 6 months as noted, where there can be a delay in use after that period, method actions 920 and 930 are executed.

Figure 10:
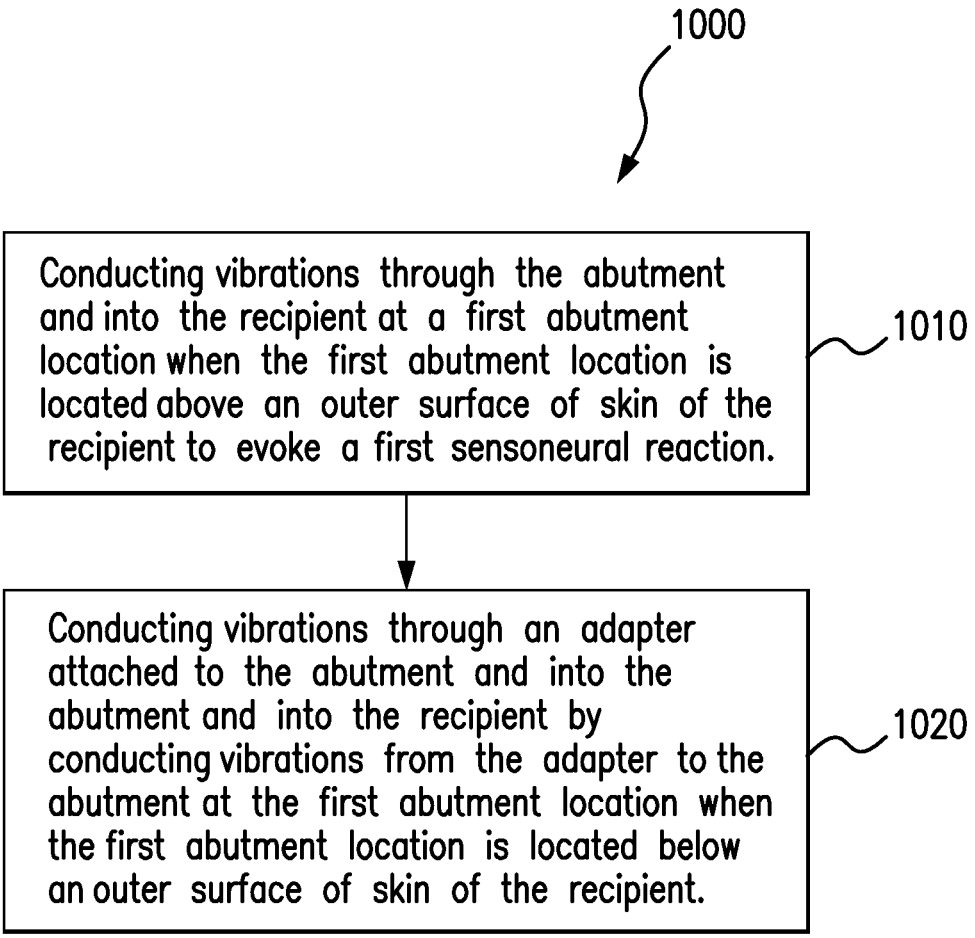
FIG. 10 depicts a flow chart representing another exemplary method according to an exemplary embodiment.

An exemplary embodiment includes method 1000 as depicted in FIG. 10, which includes method action 1010 entailing the action of conducting vibrations through the abutment and into the recipient to evoke a first sensoneural reaction. In an exemplary embodiment, this is done prior to the action of attaching an adapter to the abutment. Method 1010 further includes conducting vibrations from the operationally removable component directly to the abutment at a first abutment location when the first abutment location is located above an outer surface of skin of the recipient. For example, method 1010 is executed utilizing an abutment located relative to the outer surface of the skin as depicted, for example, in FIG. 2A. Method 1000 further includes method action 1020, which entails conducting vibrations through an adapter attached to the abutment and into the abutment and into the recipient by conducting vibrations from the adapter to the abutment at the first abutment location when the first abutment location is located below an outer surface of skin of the recipient. Such a method action can be executed utilizing the configuration depicted in, for example, FIGS. 6A, 6B, 7A and/or 7B. In an exemplary embodiment, method 1000 further includes the action of, between method action 1010 and method action 1020, attaching an adapter as detailed herein and/or variations thereof. Such an adapter can correspond to, for example, adapter 650 or 750.

Figure 11:
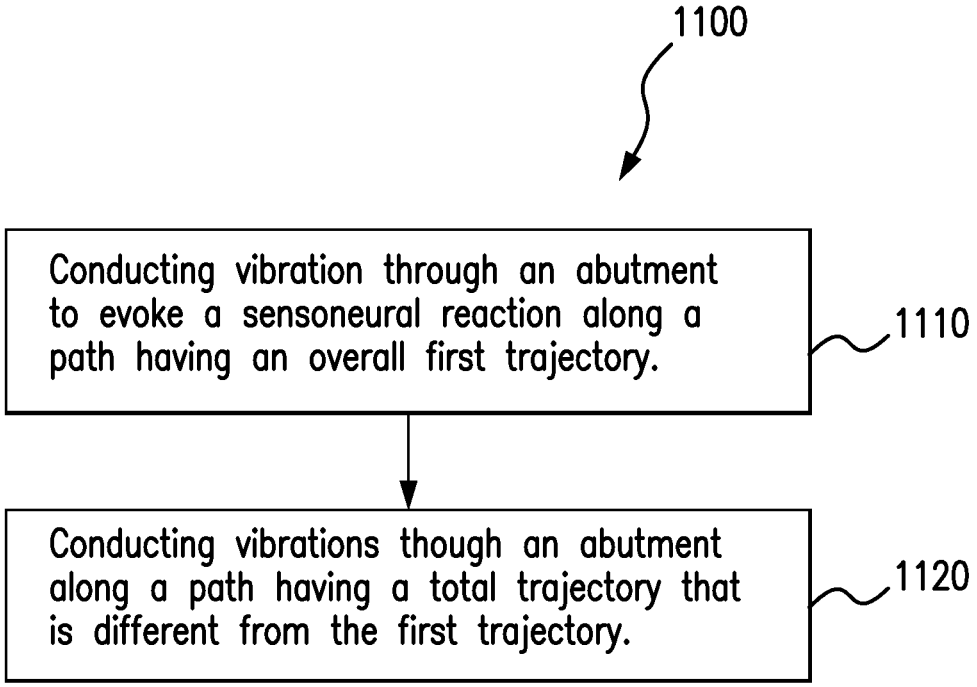
FIG. 11 depicts a flow chart representing another exemplary method according to an exemplary embodiment.

An exemplary embodiment includes a method entailing conducting vibrations through an adapter and from the adapter into an abutment and from the abutment into the recipient, either directly or indirectly, to evoke a sensoneural reaction. In this regard, FIG. 11 presents method 1100, which includes method action 1110, entailing conducting vibrations through the abutment by conducting vibrations along a path having an overall first trajectory. In an exemplary embodiment, this first trajectory is linear. In an exemplary embodiment, method action 1110 can be executed utilizing the configuration of FIG. 2A or the configuration of FIG. 7A. That is, the aforementioned action need not be practiced with an abutment having a substantially normal alignment with the tangent surfaces of the skin or the bone. By "overall trajectory," it is meant the trajectory from the portion of the abutment into which the vibrations are inputted to the portion of the abutment where the vibrations enter another element (e.g., from face 721 to the interface section of the abutment and bone fixture (or abutment and bone, if the abutment is directly attached to bone). Method 1100 further includes method action 1120, which entails, conducting vibrations through an adapter along a path having a total second trajectory that is different from the first trajectory. In an exemplary embodiment, this method action 1120 can be executed utilizing the configuration of FIG. 7A. In an exemplary embodiment, the total second trajectory is nonlinear, although in other embodiments, the total second trajectory can be linear. By "total trajectory," with respect to the adapter 650, it is meant the trajectory from the top of the adapter to the bottom of the adapter (e.g., from face 751 to face 751).

It is noted that method action 1110 can be practiced simultaneously with method action 1120. In an exemplary embodiment, a method action as follows can be substituted for method action 1120 and/or can be added to method actions 1110 and 1120. This method action can entail conducting vibrations through the adapter and into the abutment and then into the recipient (either directly or indirectly through the bone fixture) along a path having a total third trajectory that is different from the first trajectory and/or the second trajectory. In an exemplary embodiment, the total third trajectory is non-linear.

Referring to FIGS. 2A and 7, an exemplary embodiment includes a method that includes the action of conducting vibrations through the abutment and into the recipient to evoke a first sensoneural reaction prior to the action of attaching the adapter, wherein the vibrations are conducted through the abutment along a first trajectory (e.g., along the longitudinal axis 219 thereof) that is substantially normal to a tangent surface of an extrapolated surface of skin of the recipient proximate the abutment (such as proximate as detailed above with respect to the distances). An exemplary embodiment of this method can be executed utilizing the configuration of, for example, FIG. 2A and/or any of FIGS. 3A-5B. This exemplary method further includes the action of conducting vibrations through an adapter, such as for example adapter 750, and the abutment and into the recipient to evoke a second sensoneural reaction. The vibrations are conducted through the abutment along a second trajectory that is substantially non-normal to the tangent surface (e.g., such as along axis 719), and the vibrations travel into the adapter from an operationally removable component (e.g., 290) in an overall trajectory that is parallel to the second trajectory. Such an exemplary embodiment can be executes by, for example, the configuration of FIG. 7A. Such a method can be executed in the event of, for example, the bone to which the adapter is connected grows and/or otherwise becomes deformed such that the angle of the abutment relative to the outer skin changes.

An exemplary method includes method action entailing conducting vibrations into an adapter from an operationally removable component removably coupled to an adapter. This exemplary method further includes conducting vibrations conducted into the adapter through the adapter and then from the adapter to an abutment fixed or otherwise connected to the adapter. This exemplary method also includes conducing vibrations conducted into the adapter through the adapter and then into a bone fixture implanted into bone of the recipient. The adapter is a first monolithic component and the abutment is a second monolithic component. The bone fixture is a third monolithic component. Accordingly, an embodiment includes a method of conducing vibrations from an operationally removable component to a bone conduction implant and through the bone conduction implant into bone of a recipient, where the vibrations are conducted in a serial fashion through three separate monolithic components between the operationally removable component and the bone of the recipient.

As detailed above, the operationally removable component can include a vibrator. This vibrator can utilize electromagnetic actuator and/or a piezoelectric actuator and/or any type of actuator that can enable the teachings detailed herein and/or variations thereof. In an exemplary embodiment, the vibrator includes a mass that oscillates along a trajectory, this trajectory having a tangent direction.

An exemplary method includes conducting vibrations through an abutment and into a recipient to evoke a first sensoneural reaction utilizing a unit configured to generate vibrations via oscillation of a mass component, such as the mass detailed in the prior paragraph, prior to the action of attaching an adapter to the abutment. The unit is directly connected to the abutment such that the tangential direction of the trajectory of oscillation of the mass component has a first orientation with respect to the longitudinal axis of the abutment. The method further includes the action of conducting vibrations through the adapter and the abutment and into the recipient to evoke a sensoneural reaction utilizing the first unit or a second unit different from the first unit, configured to generate vibrations via oscillation of a mass component. These units are directly connected to an adapter such that the tangential direction of the trajectory of the oscillation of the mass component has a third orientation with respect to the longitudinal axis of the abutment different from the first orientation and/or has a fourth orientation with respect to the extrapolated tangent surface of the skin surrounding the abutment as detailed herein or an extrapolated tangent surface of the skin surrounding the adapter that is substantially the same as the second orientation.

Figure 12:
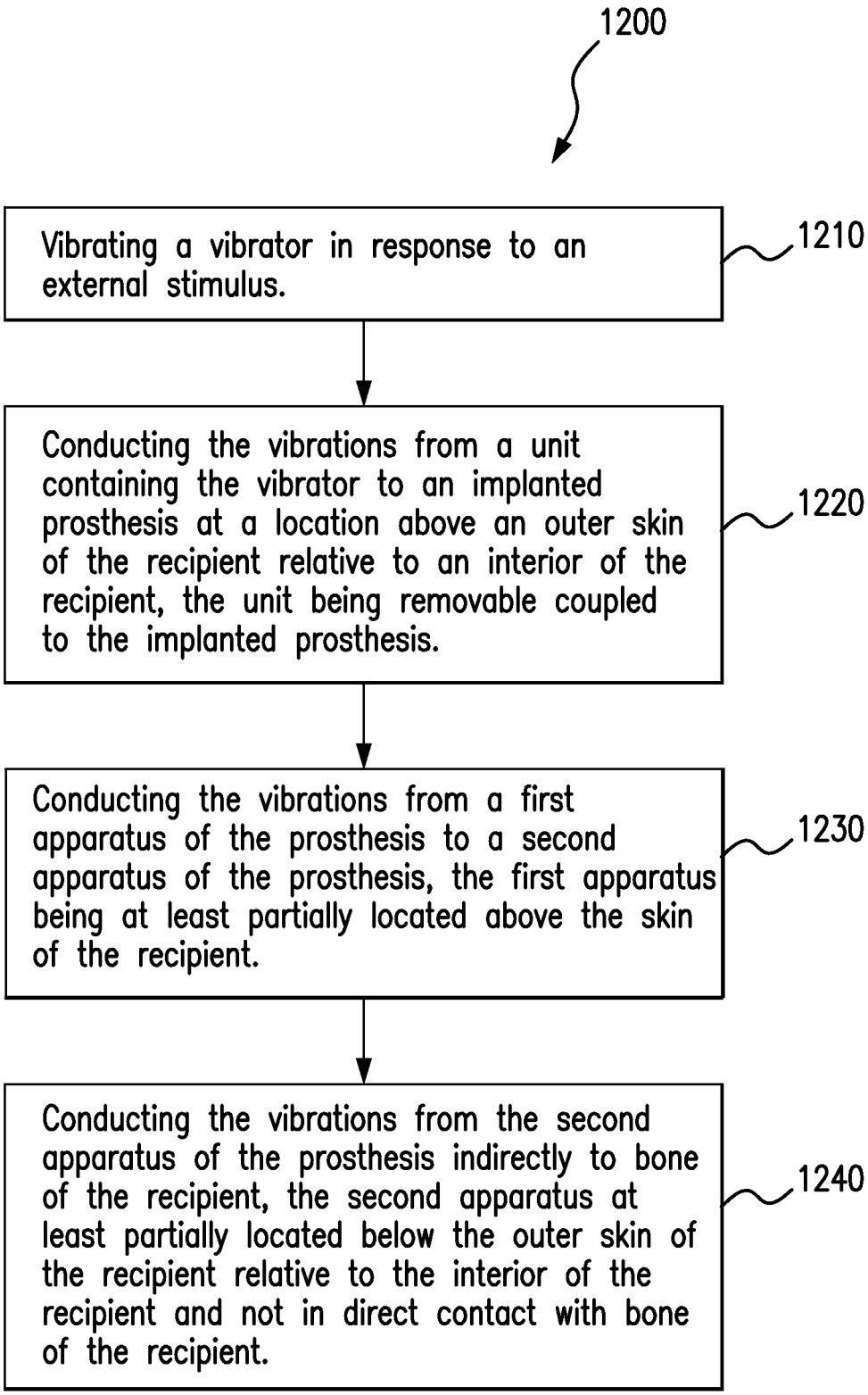
FIG. 12 depicts a flow chart representing another exemplary method according to an exemplary embodiment.

FIG. 12 presents an alternate method, method 1200, which is a method of imparting vibrations into a recipient. Method 1200 includes method action 1210, entailing vibrating a vibrator in response to an external stimulus. Method 1200 further includes method action 1220, which entails conducting the vibrations from a unit, such as any of the operationally removable components detailed above (e.g., 290, 390, 490, etc.), containing the vibrator to an implanted prosthesis at a location above an outer skin of the recipient relative to an interior of the recipient, the unit being removably coupled to the implanted prosthesis. Method 1200 further includes method action 1230, which entails conducting the vibrations from a first apparatus of the implanted prosthesis (e.g., any of the adapters detailed herein and/or variations thereof) to a second apparatus of the prosthesis (e.g., any of the abutments detailed herein and/or variations thereof), the first apparatus being at least partially located above the outer skin of the recipient relative to an interior of the recipient. Method 1200 also includes method action 1240, which entails conducting the vibrations from the second apparatus of the prosthesis indirectly to bone of the recipient, the second apparatus at least partially located below the outer skin of the recipient relative to the interior of the recipient and not in direct contact with bone of the recipient. By way of example, such indirect conduction can be practiced via the use of a bone fixture. It is noted that in an exemplary embodiment, this method includes conducting a substantial amount of the vibrations from the abutment to a bone fixture. Any of FIGS. 3A-7 depict a configuration that can be utilized to practice method 1200.

Embodiments of the bone conduction implant can be used in connection with systems where sound is transmitted via the skull directly to the inner ear of a person with impaired hearing. However, embodiments of the bone conduction implant can also be configured for use in connection with other types of systems with components anchored in the skull and for ear or orbital prostheses which are also anchored in the skull. Other applications of the bone conduction implant are also contemplated. The teachings detailed herein and/or variations thereof can be utilized in an oral environment (e.g., attached to a jaw bone or the like). Also, as noted herein, embodiments can be utilized outside of the hearing prosthesis arts.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A prosthesis, comprising:

an abutment; and an operationally removable component of a bone conduction device including a vibrator, wherein a coupling component is present between the abutment and the vibrator of the operationally removable component, wherein the coupling component includes a flexible sub-component and, relative to the flexible sub-component, a relatively rigid sub-component, both the flexible sub-component and the relatively rigid sub-component being in direct contact with the abutment, the flexible sub-component extending further in a direction of the abutment than the relatively rigid sub-component.

2. The prosthesis of claim 1, wherein:

the vibrator is in vibrational communication with the coupling component.

3. The prosthesis of claim 1, wherein:

the abutment includes a female sub-component;

the coupling component includes a male sub-component received into the female sub-component of the abutment; and the male sub-component includes the flexible sub-component.

4. The prosthesis of claim 1, wherein:

the coupling component establishes part of a quick release and quick connect assembly for the operationally removable component.

5. The prosthesis of claim 1, wherein:

the coupling component is such that the abutment and the operationally removable component are globally snap-coupled to one another.

6. The prosthesis of claim 1, wherein:

the coupling component is a composite assembly that includes a first material and a second material both in direct contact with the abutment, the first material making up the flexible sub-component and the second material making up the relatively rigid sub-component.

7. The prosthesis of claim 1, wherein:

the relatively rigid sub-component is configured to directly contact an uppermost surface of the abutment; and the flexible sub-component is configured to extend into a female portion of the abutment to snap-couple thereto.

8. The prosthesis of claim 1, wherein:

the coupling component includes a first portion and a second portion, the first portion maintaining a spatial location of the removable component relative to the abutment and the second portion snap coupling to inside the abutment.

9. The prosthesis of claim 1, wherein:

the coupling component is an assembly including the flexible sub-component and the relatively rigid sub-component; and the prosthesis includes a threaded bone anchor portion and a portion of the abutment contacting the relatively rigid sub-component is in vibrational communication with the threaded bone anchor portion.

10. A method, comprising:

obtaining a removable component of a percutaneous bone conduction device; and attaching the removable component to a skin penetrating assembly implanted in a recipient, wherein the skin penetrating assembly includes a skin penetrating abutment, at least after attachment of the removable component to the skin penetrating assembly, a first structural element directly abuts a topmost surface of the abutment, and a second structural element extends below the topmost surface of the abutment to secure the second structural element to the abutment and thus ultimately secure the removable component to the recipient, and the first structural element is a separate structural component from the second structural element.

11. The method of claim 10, wherein:

the first structural element is relatively more rigid than the second structural element.

12. The method of claim 10, wherein:

the second structural element snap-couples to the abutment.

13. The method of claim 10, wherein:

the first structural element is made of different material than the second structural element.

14. The method of claim 10, wherein:

the second structural element extends into a female portion of the abutment to couple thereto.

15. The method of claim 10, further comprising:

transferring vibrations from the removable component to the recipient via the first structural element.

16. A prosthesis, comprising:

a skin penetrating assembly configured to be anchored to bone of a recipient; and an operationally removable component of a hearing prosthesis including a vibrator removably attached to the skin penetrating assembly, wherein the skin penetrating assembly includes an abutment and a threaded section configured to be screwed into bone to anchor the skin penetrating assembly to the bone, and the prosthesis includes an abutment interface that interfaces with the abutment at a section of the abutment opposite the threaded section to hold a portion of the prosthesis that is located on an opposite side of the abutment interface from the abutment to the skin penetrating assembly, wherein the abutment interface is an assembly of at least two separate elements.

17. The prosthesis of claim 16, wherein the at least two separate elements includes at least a first element and a second element, the second element being relatively more flexible than the first element.

18. The prosthesis of claim 17, wherein:

the second element is snap-coupled to the abutment.

19. The prosthesis of claim 18, wherein:

the second element includes fingers.

20. The prosthesis of claim 18, wherein:

the first element abuts a topmost surface of the abutment.

21. The prosthesis of claim 20, wherein:

a first flat surface is located on the first element, wherein the first flat surface is normal to a longitudinal axis of the abutment when the second element is snap-coupled to the abutment, and a second flat surface is located on the abutment, wherein the second flat surface is normal to the longitudinal axis, wherein the first flat surface and the second flat surface are in parallel contact with each other.

22. The prosthesis of claim 16, wherein a first element of the at least two separate elements contacts a topmost surface of the abutment and wherein a second element of the at least two separate elements enters the abutment, the second element having a flexible portion.

23. The prosthesis of claim 22, wherein:

the second element is snap-coupled to the abutment.

24. The prosthesis of claim 23, wherein:

the second element includes fingers.

25. The prosthesis of claim 23, wherein:

the first element has a first flat surface that is normal to a longitudinal axis of the abutment when the second element is snap-coupled to the abutment, and the abutment has a second flat surface that is normal to the longitudinal axis, wherein the first flat surface and the second flat surface are in parallel contact with each other.

* * * * *